US009816517B2

(12) United States Patent
Taguchi et al.

(10) Patent No.: US 9,816,517 B2
(45) Date of Patent: Nov. 14, 2017

(54) TURBO-COMPRESSOR AND REFRIGERATION CYCLE APPARATUS WITH HEATED GUIDE VANES

(71) Applicant: Panasonic Corporation, Osaka (JP)

(72) Inventors: Hidetoshi Taguchi, Osaka (JP); Tomoichiro Tamura, Osaka (JP); Tadayoshi Shoyama, Osaka (JP); Kazuyuki Kouda, Osaka (JP); Mamoru Nishibu, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 466 days.

(21) Appl. No.: 14/496,214

(22) Filed: Sep. 25, 2014

(65) Prior Publication Data

US 2015/0086394 A1 Mar. 26, 2015

(30) Foreign Application Priority Data

Sep. 25, 2013 (JP) ..... 2013-198037
Jun. 25, 2014 (JP) ..... 2014-129947

(51) Int. Cl.
*F04D 27/00* (2006.01)
*F04D 25/02* (2006.01)
(Continued)

(52) U.S. Cl.
CPC ..... *F04D 27/006* (2013.01); *F04D 25/02* (2013.01); *F04D 25/06* (2013.01);
(Continued)

(58) Field of Classification Search
CPC ..... F04D 25/02; F04D 25/06; F04D 27/006; F04D 27/0276; F04D 29/4213;
(Continued)

(56) References Cited

U.S. PATENT DOCUMENTS 3,041,848 A * 7/1962 Greenwald ..... F04D 27/0215 415/120
4,878,355 A * 11/1989 Beckey ..... F25B 31/008 62/115
(Continued)

FOREIGN PATENT DOCUMENTS

EP 1 826 887 8/2007
EP 2 322 805 5/2011
(Continued)

OTHER PUBLICATIONS

Extended European Search Report issued Apr. 14, 2015 in corresponding European Patent Application No. 14186218.5.

*Primary Examiner* — Peter J Bertheaud
*Assistant Examiner* — Joseph Herrmann
(74) *Attorney, Agent, or Firm* — Wenderoth, Lind & Ponack, L.L.P.

(57) ABSTRACT

A turbo-compressor includes an impeller, a motor that generates heat by rotation and rotatably drives the impeller, a fluid passage through which a working fluid is forced by the impeller, and a heating mechanism that transfers the heat generated by the rotation of the motor to fluid upstream of the impeller so as to heat the working fluid at the inlet of the fluid passage.

10 Claims, 9 Drawing Sheets

(51) Int. Cl.

| | |
|---|---|
| ***F04D 29/58*** | (2006.01) |
| ***F04D 25/06*** | (2006.01) |
| ***F04D 27/02*** | (2006.01) |
| ***F04D 29/42*** | (2006.01) |
| ***F04D 29/44*** | (2006.01) |

(52) U.S. Cl.
CPC ..... *F04D 27/0276* (2013.01); *F04D 29/4213* (2013.01); *F04D 29/444* (2013.01); *F04D 29/5806* (2013.01); *F04D 29/5833* (2013.01); *F05D 2250/51* (2013.01)

(58) Field of Classification Search
CPC ..... F04D 29/444; F04D 29/5806; F04D 29/5826; F04D 29/5833; F04D 29/582–29/5846; F05D 2250/51
See application file for complete search history.

(56) References Cited

U.S. PATENT DOCUMENTS

| | | | | |
|---|---|---|---|---|
| 5,816,055 | A * | 10/1998 | Ohman | F04C 28/12 62/117 |
| 5,904,471 | A | 5/1999 | Woollenweber et al. | |
| 6,129,524 | A | 10/2000 | Woollenweber et al. | |
| 6,718,781 | B2 * | 4/2004 | Freund | F25B 49/02 62/199 |
| 8,021,127 | B2 * | 9/2011 | De Larminat | F04C 29/045 417/366 |
| 2007/0200438 | A1 | 8/2007 | Kaminski et al. | |
| 2007/0212232 | A1 | 9/2007 | De Larminat | |
| 2009/0087298 | A1 | 4/2009 | Shibata | |
| 2011/0300006 | A1 | 12/2011 | Larminat | |
| 2012/0251351 | A1 | 10/2012 | Van Der Span | |

FOREIGN PATENT DOCUMENTS

| | | |
|---|---|---|
| JP | 08-233382 | 9/1996 |
| JP | 2004-218893 | 8/2004 |
| JP | 4109997 | 7/2008 |
| JP | 2009-085044 | 4/2009 |
| WO | 98/30790 | 7/1998 |

* cited by examiner

TURBO-COMPRESSOR AND REFRIGERATION CYCLE APPARATUS WITH HEATED GUIDE VANES

BACKGROUND

1. Technical Field

The present disclosure relates to a turbo-compressor and a refrigeration cycle apparatus including the turbo-compressor.

2. Description of the Related Art

There is so far known a technique for suppressing the occurrence of erosion that is caused by a liquid having accumulated on a casing surface of a turbo-compressor. Japanese Unexamined Patent Application Publication No. 8-233382 discloses a turbo-refrigerator in which a heating device for a gas coolant inlet into a turbo-compressor is disposed in an inlet pipe of the turbo-compressor. The heating device is disposed in the inlet pipe at a position nearer to an evaporator than an inlet vane.

Japanese Unexamined Patent Application Publication No. 2009-85044 discloses a turbo-compressor including an open-type impeller, a casing, and a heating means for heating the casing. Because the heating means heats the casing, a main flow of steam is suppressed from being condensed upon contact with the casing.

Japanese Patent No. 4109997 discloses a turbo-compressor including an inlet vane. According to Japanese Patent No. 4109997, the flow rate of a working fluid inlet through an inlet of the turbo-compressor is controlled in accordance with the opening degree of an inlet guide vane that is disposed at the compressor inlet.

In the related-art turbo-compressor, however, it is demanded to increase a degree of superheat of the working fluid inlet into the impeller, and to improve durability of the turbo-compressors.

SUMMARY

According to one aspect of the present disclosure, there is provided a turbo-compressor including an impeller, a motor that generates heat by rotation of the motor and rotatably drives the impeller, a fluid passage through which a working fluid is passed via the impeller, and a heating mechanism that transfers the heat generated with the rotation of the motor to the fluid passage upstream of the impeller, to heat the working fluid inlet into the fluid passage with rotation of the impeller. The working fluid is compressed in the fluid passage downstream of the impeller.

With the turbo-compressor described above, the desired operating conditions of the turbo-compressor can be maintained more easily, and durability of the turbo-compressor can be improved.

DETAILED DESCRIPTION

Figure 1:
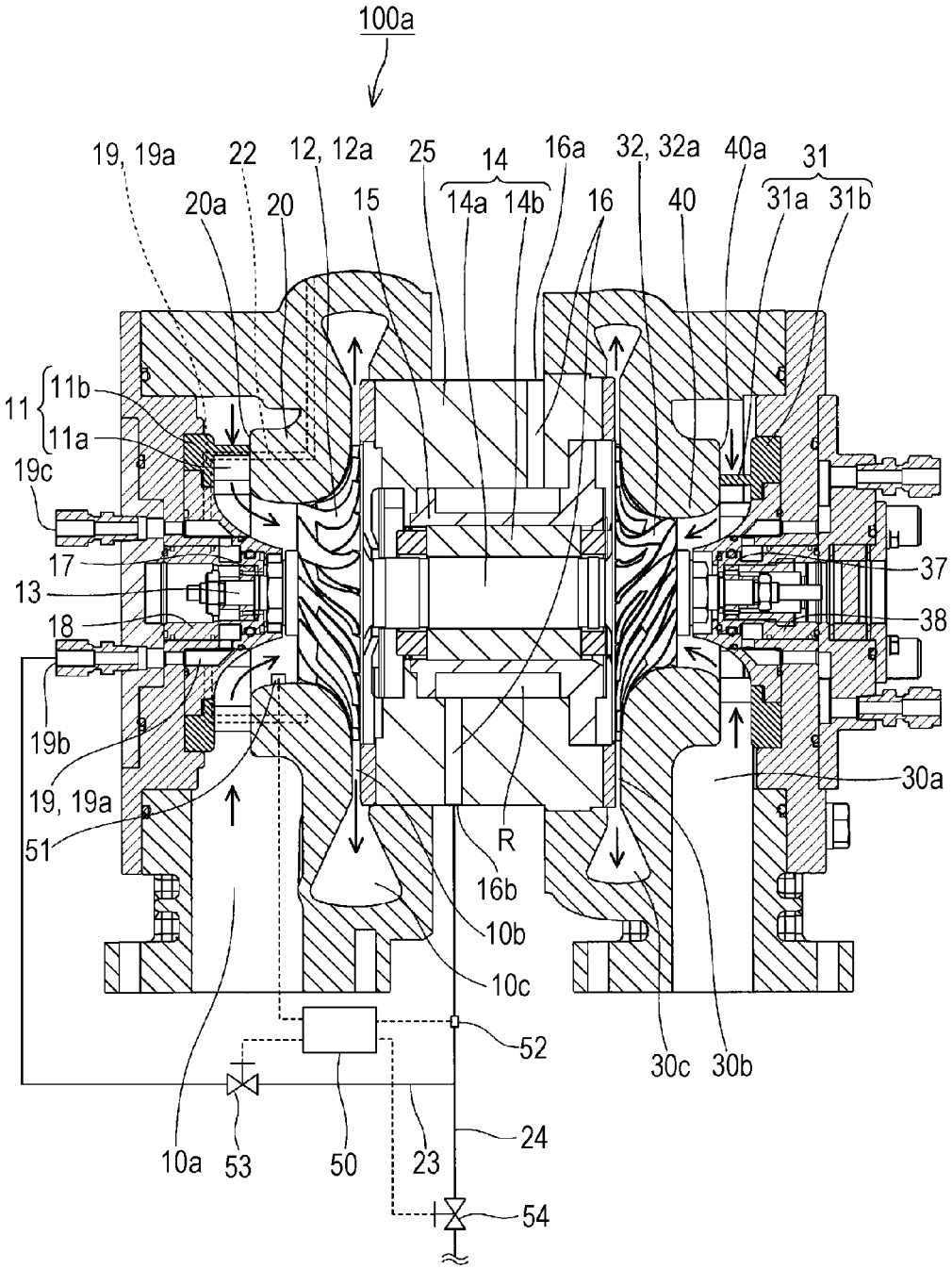
FIG. 1 is a cross sectional view of a turbo-compressor according to a first embodiment.

In Japanese Unexamined Patent Application Publication No. 8-233382, the gas coolant inlet into the turbo-compressor is heated by the heating device. Furthermore, "exhaust heat of return oil at temperature raised after lubricating the turbo-compressor" is utilized as a heat source of the heating device. However, Japanese Unexamined Patent Application Publication No. 8-233382 does not suggest the use of heat generated from a motor (exhaust heat of a motor) that rotates a shaft of the turbo-compressor, i.e., the use of heat generated due to stray load loss, which is caused by leakage magnetic flux of the motor, in order to heat the gas coolant injected to the turbo-compressor. The term "lubrication" used here implies "making smooth friction surfaces of machines and so on with oil or pharmaceuticals to prevent friction, wear, etc. of the friction surfaces" (see "*Kojien*" (Japanese Language Dictionary), 5th edition). In the turbo-compressor, a portion requiring the "lubrication" is a bearing unit. It is therefore thought that Japanese Unexamined Patent Application Publication No. 8-233382 utilizes, as the heat source for the heating device, friction heat generated in the bearing unit of the turbo-compressor without utilizing the exhaust heat of the motor. As a result of conducting intensive studies, the inventors have found the fact that the amount of heat generated in the bearing unit is not sufficient to heat the working fluid containing water as a main component, and that the exhaust heat of the motor is provides larger calorie than the heat generated in the bearing unit. In other words, the inventors have found the fact that the exhaust heat of the motor is more suitable as the heat source to heat the working fluid injected to the turbo-compressor. On the basis of those findings, the inventors have conceived disclosures set forth in the following embodiments of the present disclosure.

According to a first aspect of the present disclosure, there is provided a turbo-compressor including an impeller, a motor that generates heat by rotation of the motor and rotatably drives the impeller, a fluid passage through which a working fluid is passed via the impeller, and a heating mechanism that transfers the heat generated with the rotation of the motor to the fluid passage upstream of the impeller, to heat the working fluid inlet into the fluid passage with rotation of the impeller. The working fluid is compressed in the fluid passage downstream of the impeller.

With the first aspect, exhaust heat of the motor can be used to heat the working fluid that is injected into the compressor. It is hence possible to eliminate the need of providing a separate heat source, and to prevent reduction in efficiency of the turbo-compressor, which is otherwise caused by the provision of the heating mechanism. Furthermore, in the case of utilizing the exhaust heat of the motor, the working fluid injected into the turbo-compressor can be heated sufficiently. Therefore, a degree of superheat of the working fluid can be increased. As a result, the desired operating conditions of the turbo-compressor can be maintained more easily, and durability of the turbo-compressor can be improved.

According to a second aspect of the present disclosure, as an exemplary modification in relation to the first aspect, a cooling flow passage that is supplied with a fluid via the motor, the fluid being used for cooling the motor when the fluid is passed via the motor, and a heating flow passage that is supplied with the fluid, the fluid being used for heating the fluid passage upstream of the impeller when the fluid is passed around the fluid passage and transfers heat of the fluid passed through the heating flow passage to the fluid passage upstream of the impeller, and wherein the cooling flow passage is connected with the heating flow passage, the fluid having passed through the cooling flow passage being supplied to the heating flow passage as the fluid for heating the fluid passage.

With the second aspect, the heating mechanism can be constituted in a simple structure.

According to a third aspect of the present disclosure, as an exemplary modification in relation to the first aspect, the heating mechanism includes a cooling flow passage that is supplied with a fluid, the fluid being used for cooling the motor when the fluid is passed via the motor, and a heating flow passage that is disposed in intersection relation to the fluid passage upstream of the impeller, and that is supplied with the fluid, the fluid being used for heating the fluid passage when the fluid is passed through the intersection of the heating flow passage and the fluid passage, wherein the cooling flow passage is connected with the heating flow passage, the fluid having passed through the cooling flow passage being supplied to the heating flow passage as the fluid for heating the fluid passage.

With the third aspect, the heating mechanism can be constituted in a simple structure.

According to a fourth aspect of the present disclosure, as an exemplary modification in relation to the first aspect, the heating mechanism includes a cooling flow passage that is supplied with a fluid, the fluid being used for cooling the motor when the fluid is passed via the motor, and a heating flow passage that is disposed in contact with an outer circumference of the fluid passage upstream of the impeller, and that is supplied with the fluid, the fluid being used for heating the fluid passage when the fluid is passed through the contact section of the heating flow passage and the fluid passage, wherein the cooling flow passage is connected with the heating flow passage, the fluid having passed through the cooling flow passage being supplied to the heating flow passage as the fluid for heating the fluid passage.

In this specification, the expression "the heating flow passage that is disposed in contact with an outer circumference of the fluid passage" implies that the heating flow passage and the fluid passage are close to each other to such an extent that the heat of the fluid supplied to the heating flow passage can be transferred to the working fluid passing through the fluid passage.

With the fourth aspect, the heating mechanism can be constituted in a simple structure.

According to a fifth aspect of the present disclosure, as an exemplary modification in relation to the third aspect, the turbo-compressor further comprising a casing that surrounds the impeller, wherein the casing constitutes a part of the fluid passage, the heating flow passage is inserted in the fluid passage part of which is constituted by the casing, and heat of the fluid supplied to the heating flow passage is transferred from an outer circumference of the heating flow passage to the working fluid passing through the fluid passage that is constituted by the casing.

With the fifth aspect, since the fluid passage is partly constituted by the casing that surrounds the impeller, the structure of the turbo-compressor can be simplified in the case of trying to heat the working fluid by utilizing the exhaust heat of the motor.

Furthermore, with such an arrangement, the heating flow passage is inserted in the fluid passage that is partly constituted by the casing. Thus, the heat of the fluid supplied to the heating flow passage is transferred to the working fluid passing through the fluid passage, which is constituted by the casing, from the outer circumference of the heating flow passage. In other words, because the casing is disposed near the impeller, the heat of the fluid supplied to the heating flow passage can be transferred to the working fluid near the impeller. Hence, the degree of superheat of the working fluid can be increased at a location nearer to the impeller than in the related art. As a result, it is possible to prevent damage of the impeller, to more easily maintain the desired operating conditions of the turbo-compressor, and to improve durability of the turbo-compressor.

The turbo-compressor according to the fifth aspect of the present disclosure is superior in the following points to the turbo-refrigerator disclosed in Japanese Unexamined Patent Application Publication No. 8-233382 and the turbo-compressor disclosed in Japanese Unexamined Patent Application Publication No. 2009-85044.

In the turbo-refrigerator disclosed in Japanese Unexamined Patent Application Publication No. 8-233382, the working fluid is heated by the heating device that serves as a heat source. However, the heat source is not arranged near the impeller. Accordingly, there is a possibility that even when the working fluid is heated by the heat source, the working fluid may be condensed until the working fluid is inlet into the impeller. This leads to a possibility that the impeller may be damaged.

In the turbo-compressor disclosed in Japanese Unexamined Patent Application Publication No. 2009-85044, the fluid passage for the working fluid is formed in a U-like shape, and the working fluid having dissipated heat after passing through the U-shaped fluid passage is heated by utilizing the temperature of the working fluid itself. Thus, because the working fluid having dissipated heat after passing through the U-shaped fluid passage is heated at one lateral surface of the U-shaped fluid passage, there is a possibility that the heated temperature of the working fluid may be insufficient. Namely, as in the case of Japanese Unexamined Patent Application Publication No. 8-233382, there is a possibility that even when the working fluid is heated, the working fluid may be condensed until the working fluid is inlet into the impeller. This leads to a possibility that the impeller may be damaged.

In contrast, with the turbo-compressor according to the present disclosure, the heating flow passage is inserted in the fluid passage near the impeller. Therefore, the working fluid can be suppressed from being condensed until the working fluid is inlet into the impeller after being heated by the heat source. As a result, damage of the impeller can be suppressed significantly.

According to a sixth aspect of the present disclosure, as an exemplary modification in relation to the fourth aspect, the turbo-compressor further comprising a casing that surrounds the impeller, wherein the casing constitutes a part of the fluid passage, the flow passage constituted by a part of the casing includes a heating member therein, the heating flow passage is disposed in contact with the outer circumference of the flow passage constituted by the casing, and heat of the fluid supplied to the heating flow passage is transferred to the heating member and is transferred, via the heating member, to the working fluid passing through the fluid passage that is constituted by the casing.

With the sixth aspect, since the fluid passage is partly constituted by the casing that surrounds the impeller, the structure of the turbo-compressor can be simplified in the case of trying to heat the working fluid by utilizing the exhaust heat of the motor.

Furthermore, the heating member is disposed in the fluid passage that is partly constituted by the casing. The heating flow passage is disposed in contact with the outer circumference of the flow passage constituted by the casing. Thus, the heat of the fluid supplied to the heating flow passage is transferred, via the heating member, from the heating flow passage to the working fluid passing through the fluid passage that is constituted by the casing. In other words, the heat of the fluid supplied to the heating flow passage can be transferred to the working fluid near the impeller. Hence, the degree of superheat of the working fluid can be increased at a location nearer to the impeller than in the related art. As a result, it is possible to prevent damage of the impeller, to more easily maintain the desired operating conditions of the turbo-compressor, and to improve durability of the turbo-compressor.

The turbo-compressor according to the sixth aspect of the present disclosure is superior in the following points to the turbo-refrigerator disclosed in Japanese Unexamined Patent Application Publication No. 8-233382 and the turbo-compressor disclosed in Japanese Unexamined Patent Application Publication No. 2009-85044.

In the turbo-refrigerator disclosed in Japanese Unexamined Patent Application Publication No. 8-233382, the working fluid is heated by the heating device that serves as a heat source. However, the heat source is not arranged near the impeller. Accordingly, there is a possibility that even when the working fluid is heated by the heat source, the working fluid may be condensed until the working fluid is inlet into the impeller. This leads to a possibility that the impeller may be damaged.

In the turbo-compressor disclosed in Japanese Unexamined Patent Application Publication No. 2009-85044, the fluid passage for the working fluid is formed in a U-like shape, and the working fluid having dissipated heat after passing through the U-shaped fluid passage is heated by utilizing the temperature of the working fluid itself. Thus, because the working fluid having dissipated heat after passing through the U-shaped fluid passage is heated at one lateral surface of the U-shaped fluid passage, there is a possibility that the heated temperature of the working fluid may be insufficient. Namely, as in the case of Japanese Unexamined Patent Application Publication No. 8-233382, there is a possibility that even when the working fluid is heated, the working fluid may be condensed until the working fluid is inlet into the impeller. This leads to a possibility that the impeller may be damaged.

In contrast, with the turbo-compressor according to the present disclosure, the heating flow passage is disposed in contact with the circumference of the fluid passage, which is constituted by the casing, near the impeller. Therefore, the working fluid can be suppressed from being condensed until the working fluid is inlet into the impeller after being heated by the heat source. As a result, damage of the impeller can be suppressed significantly.

According to a seventh aspect of the present disclosure, as an exemplary modification in relation to the fifth aspect, a part of the heating flow passage is a flow passage penetrating through an inlet guide vane that adjusts a direction of flow of the working fluid flowing toward the impeller.

With the seventh aspect, since the inlet guide vane that adjusts the direction of flow of the working fluid flowing toward the impeller functions also as the heating flow passage, the working fluid can be effectively heated while the structure of the turbo-compressor is simplified.

The turbo-compressor disclosed in Japanese Patent No. 4109997 includes the inlet guide vane. However, Japanese Patent No. 4109997 does not disclose the configuration in which the working fluid is heated from the outside of the fluid passage. Thus, the inlet guide vane does not function as the heating flow passage.

According to an eighth aspect of the present disclosure, as an exemplary modification in relation to the seventh aspect, the turbo-compressor further comprising a vane member, the vane member including a base on which the inlet guide vane is arranged, and the inlet guide vane, wherein the base forms a part of the heating flow passage, and the part of the heating flow passage formed in the base is coupled to the inlet guide vane that serves as the heating flow passage.

With the eighth aspect, since the heated fluid heats the working fluid in a state in contact with the working fluid through the base and the inlet guide vane, the working fluid can be effectively heated while the structure of the turbo-compressor is simplified.

According to a ninth aspect of the present disclosure, as an exemplary modification in relation to the seventh or eighth aspect, the casing has a contact surface contacting the inlet guide vane, wherein the casing includes a casing flow passage that is opened to the contact surface, and that extends up to a space outside the casing, and wherein the heating flow passage penetrates through the inlet guide vane to be communicated with the casing flow passage.

With the ninth aspect, since the fluid for heating the inlet guide vane flows through the inside of the inlet guide vane and the casing flow passage, the fluid is less apt to stagnate inside the inlet guide vane. Therefore, the working fluid can be stably heated in a continued way by the heating fluid flowing through the inlet guide vane.

According to a tenth aspect of the present disclosure, as an exemplary modification in relation to any one of the seventh to ninth aspects, the heating flow passage has an inlet on side opposite to the impeller with the inlet guide vane interposed between the inlet and the impeller.

With the tenth aspect, the fluid flowing through the heating flow passage is less apt to be affected by heat generated in the impeller. Therefore, the temperature of the fluid flowing through the heating flow passage can be avoided from varying due to other factors.

According to an eleventh aspect of the present disclosure, as an exemplary modification in relation to any one of the seventh to tenth aspects, temperature of the fluid supplied to the heating flow passage is higher than temperature of the working fluid in contact with the outer circumference of the inlet guide vane.

With the eleventh aspect, the working fluid can be reliably heated by the inlet guide vane.

According to a twelfth aspect of the present disclosure, as an exemplary modification in relation to any one of the second to eleventh aspects, the turbo-compressor further includes an inlet temperature sensor that detects temperature of the working fluid at front end side of the impeller, a heating-side temperature sensor that detects temperature of the fluid in the heating flow passage or temperature of the fluid to be supplied to the heating flow passage, a valve disposed in the heating flow passage upstream of a position at which the working fluid passing through the fluid passage is heated by the fluid flowing through the heating flow passage, and a controller controlling the valve to be closed when the fluid temperature detected by the heating-side temperature sensor is lower than the temperature of the working fluid detected by the inlet temperature sensor.

With the twelfth aspect, the fluid at lower temperature than the working fluid at the front end side of the impeller can be avoided from being supplied to the heating flow passage. As a result, the working fluid can be prevented from being cooled and condensed.

According to a thirteenth aspect of the present disclosure, as an exemplary modification in relation to any one of the first to twelfth aspects, the working fluid comprises a fluid having a negative saturated vapor pressure at an ordinary temperature.

The degree of superheat of vapor of the working fluid flowing toward the impeller of the turbo-compressor is comparatively small. Therefore, the working fluid flowing toward the impeller is changed to saturated vapor or wet steam even when slightly cooled. Thus, the effect of preventing condensation of the working fluid flowing toward the impeller can be more easily obtained with the feature of the thirteenth aspect of the present disclosure.

In the turbo-compressor disclosed in Japanese Patent No. 4109997, there is a possibility that vapor of the working fluid, which is generated in the evaporator, may not reach a state of the sufficient degree of superheat depending on the outside air temperature, etc. This leads to a possibility that the working fluid may become saturated vapor or wet steam because the working fluid is cooled in the flow passage extending from the evaporator to the turbo-compressor. In such a case, there is a possibility that the volumetric flow of the working fluid may be reduced, and the working fluid inlet into the impeller may come into an undesired state. For example, when the working fluid contains water as a main component, the volume ratio between the working fluid in liquid phase and the working fluid in vapor phase is about 1000 times under the atmospheric pressure. Thus, there is a risk that the turbo-compressor may be operated under conditions, which cannot be compensated for by adjustment of the flow of the working fluid with the inlet guide vane. In addition, when the working fluid containing droplets is inlet into the impeller of the turbo-compressor, there is a risk that those droplets may strike against the blades of the impeller, thereby causing erosion. This may result in a risk that the desired operating conditions of the turbo-compressor cannot be maintained, and durability of the turbo-compressor is reduced.

Furthermore, when a coolant having a negative saturated vapor pressure at an ordinary temperature is used as the working fluid, the impeller in the turbo-compressor is required to be rotated at a higher rotational speed. Moreover, in the case of employing the coolant having a negative saturated vapor pressure at an ordinary temperature, even when droplets are contained in the coolant in such a slight amount as not problematic in the case of employing a coolant having a positive saturated vapor pressure (i.e., pressure equal to or higher than the atmospheric pressure in terms of absolute pressure) at an ordinary temperature, erosion of the blades of the impeller occurs due to collision of the droplets (condensed working fluid) against the blades of the impeller.

In contrast, the turbo-compressor according to the present disclosure has an especially significant effect that, even when the coolant having a negative saturated vapor pressure at an ordinary temperature is used as the working fluid, the desired operating conditions of the turbo-compressor can be maintained more easily, and durability of the turbo-compressor can be improved in comparison with the turbo-compressor of the related art.

According to a fourteenth aspect of the present disclosure, there is provided a refrigeration cycle apparatus including the turbo-compressor according to any one of the second to twelfth aspects, a condenser that condenses the working fluid having been compressed by the turbo-compressor, a depressurization mechanism that reduces pressure of the working fluid having been condensed by the condenser, and an evaporator that evaporates the working fluid having been depressurized by the depressurization mechanism, the above-mentioned flow passage including connection passages that connect the turbo-compressor, the condenser, the depressurization mechanism, and the evaporator in a looped way in mentioned order, wherein the refrigeration cycle apparatus further includes (i) an injection passage at evaporator side, which connects the evaporator to a particular position of the turbo-compressor in communication with the heating flow passage, or (ii) a connecting injection passage that connects the connection passage between the condenser and the evaporator to a particular position of the turbo-compressor in communication with the heating flow passage.

With the fourteenth aspect, the refrigeration cycle apparatus including the turbo-compressor according to any one of the second to twelfth aspects can be realized.

According to a fifteenth aspect of the present disclosure, as an exemplary modification in relation to the fourteenth aspect, when the refrigeration cycle apparatus includes the injection passage at evaporator side, the injection passage at evaporator side is connected to the evaporator such that the working fluid in liquid phase is withdrawn into the injection passage at evaporator side from the evaporator, and the injection passage at evaporator side is communicated with the cooling flow passage of the turbo-compressor, and when the refrigeration cycle apparatus includes the connecting injection passage, the connecting injection passage is connected to the connection passage such that the working fluid in liquid phase is withdrawn into the connecting injection passage from the connection passage between the evaporator and the depressurization mechanism, and the connecting injection passage is communicated with the cooling flow passage of the turbo-compressor.

With the fifteenth aspect, the working fluid in liquid phase, which is at the lowest temperature in a refrigeration cycle, can be supplied to the heating flow passage after the temperature of the working fluid has increased as a result of cooling the motor. Therefore, the inlet guide vane can be heated to an appropriate temperature.

According to a sixteenth aspect of the present disclosure, as an exemplary modification in relation to the fourteenth or fifteenth aspect, the working fluid comprises a fluid having a negative saturated vapor pressure at an ordinary temperature.

The degree of superheat of vapor of the working fluid flowing toward the impeller of the turbo-compressor is comparatively small. Therefore, the working fluid flowing toward the impeller is changed to saturated vapor or wet steam even when slightly cooled. Thus, the effect of preventing condensation of the working fluid flowing toward the impeller can be more easily obtained with the feature of the sixteenth aspect of the present disclosure.

Embodiments of the present disclosure will be described below with reference to the drawings. It is to be noted that the following description is related to an example of the present disclosure, and the present disclosure is not limited by the following description.

<First Embodiment>

As illustrated in FIG. 1, a turbo-compressor 100*a* includes inlet passages 10*a* and 30*a*, diffusers 10*b* and 30*b*, volutes 10*c* and 30*c*, guide vanes 11*a* and 31*a*, impellers 12 and 32, a shaft 13, a motor 14, a motor casing 15, a cooling flow passage 16, bearings 17 and 37, bearing casings 18 and 38, a heating mechanism 19, casings 20 and 40, a casing flow passage 22, an upstream (flow) passage 23, a bypass passage 24, a center casing 25, a controller 50, an inlet temperature sensor 51, a heating-side temperature sensor 52, and valves 53 and 54.

The turbo-compressor 100*a* is a two-stage turbo-compressor including two compression mechanisms arranged in tandem. A first-stage compression mechanism is constituted by the inlet passage 10*a*, the impeller 12, the diffuser 10*b*, and the volute 10*c*. A second-stage compression mechanism is constituted by the inlet passage 30*a*, the impeller 32, the diffuser 30*b*, and the volute 30*c*.

The center casing 25 has a cylindrical shape and is arranged in a central portion of the turbo-compressor 100*a*. The motor casing 15 having a cylindrical shape is arranged inside the center casing 25. An outer circumferential surface of the motor casing 15 is recessed inwards in its central portion. Therefore, an annular space R is formed between an inner circumferential surface of the center casing 25 and the outer circumferential surface of the motor casing 15. The motor 14 is arranged inside the motor casing 15. The motor 14 includes a rotor 14*a* and a stator 14*b*.

The shaft 13 is coaxially coupled to the motor 14 and is rotated together with the motor 14. The shaft 13 extends in the axial direction of the motor 14 from each of axial ends of the motor 14. The impeller 12 is mounted to a portion of the shaft 13, the portion extending from one end of the motor 14. The impeller 32 is mounted to a portion of the shaft 13, the portion extending from the other end of the motor 14. The impellers 12 and 32 are rotated with the shaft 13 rotating together with the motor 14. One end of the shaft 13 is supported by the bearing 17. The other end of the shaft 13 is supported by the bearing 37.

The bearing 17 is arranged inside the bearing casing 18 having a cylindrical shape. An annular groove is formed in an outer circumferential surface of the bearing casing 18 and is recessed inwards near the bearing 17. The bearing 37 is arranged inside the bearing casing 38 having a cylindrical shape. An annular groove is formed in an outer circumferential surface of the bearing casing 38 and is recessed inwards near the bearing 37.

The impeller 12 is mounted to the shaft 13 in such a posture that the backside of the impeller 12 faces the motor 14. The impeller 32 is mounted to the shaft 13 in such a posture that the backside of the impeller 32 faces the motor 14. The impeller 12 includes a plurality of blades 12*a*. Each of the plural blades 12*a* has a shape curved backwards relative to the rotating direction of the impeller 12. The impeller 32 includes a plurality of blades 32*a*. Each of the plural blades 32*a* has a shape curved backwards relative to the rotating direction of the impeller 32.

The inlet passage 10*a* extends toward the front side of the impeller 12. The inlet passage 10*a* is a flow passage through which the working fluid is caused to flow toward the impeller 12. The inlet guide vane 11*a* is disposed in the inlet passage 10*a* at the front end side of the blades 12*a* of the impeller 12. In other words, the inlet guide vane 11*a* is disposed in the inlet passage 10*a* at a position in the vicinity of the blades 12*a*. The expression "position in the vicinity of the blades 12*a*" implies a position away by a predetermined distance from the front ends of the blades 12*a* along the flow passage extending toward the front side of the impeller 12. The expression "predetermined distance" implies a distance at which a coolant liquid contained in the working fluid having passed through the inlet guide vane 11*a*, heated by the heating mechanism, is not condensed. The predetermined distance can be set to, e.g., a distance that is not longer than the distance corresponding to an inlet diameter of the turbo-compressor 100*a*. The inlet guide vane 11*a* may be disposed such that it is positioned at the front end side of the blades 12*a* of the impeller 12 and is overlapped with the blades 12*a* of the impeller 12 when viewed from the axial direction of the shaft to which the impeller 12 is connected. Furthermore, the inlet guide vane 11*a* is disposed so as to partly close a part of the flow passage through which the working fluid flows toward the impeller 12. The inlet guide vane 11*a* adjusts the direction of flow of the working fluid flowing toward the impeller 12. The inlet passage 30*a* extends toward the front side of the impeller 32. The inlet passage 30*a* is a flow passage through which the working fluid is caused to flow toward the impeller 32. The inlet guide vane 31*a* is disposed in the inlet passage 30*a* at the front end side of the blades 32*a* of the impeller 32. The inlet guide vane 31*a* adjusts the direction of flow of the working fluid flowing toward the impeller 32.

Figure 2:
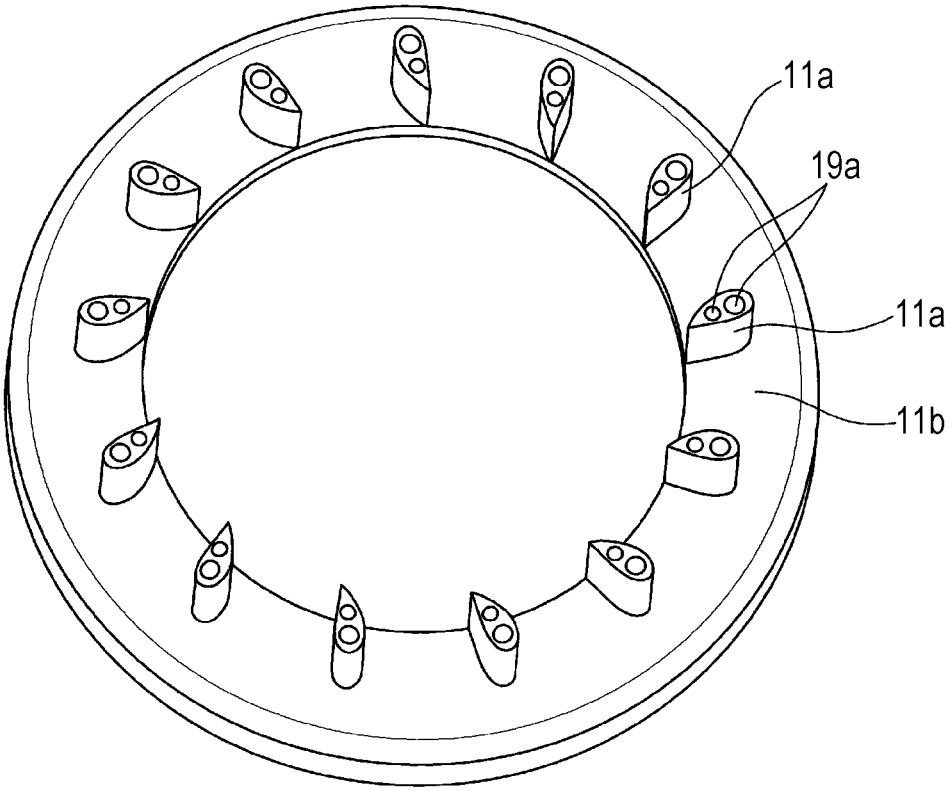
FIG. 2 is a perspective view of a vane member in FIG. 1.

As illustrated in FIG. 2, the inlet guide vane 11*a* is a part of a vane member 11. The vane member 11 includes plural inlet guide vanes 11*a* and a base 11*b* including a mounting surface onto which the inlet guide vanes 11*a* are mounted. The base 11*b* is in the form of a circular disk having a ring shape. The plural inlet guide vanes 11*a* having the same shape are mounted onto one surface (mounting surface) of the base 11*b* at equal intervals in a spiral circumferential direction of the base 11*b*. Each inlet guide vane 11*a* has a stream-line shape with one end being rounded and the other end sharpened. The one end of the inlet guide vane 11*a* is positioned on the outer circumferential side of the base 11*b*, and the other end of the inlet guide vane 11*a* is positioned on the inner circumferential side of the base 11*b*. When looking at the inlet guide vane 11*a* in the mounting surface of the base 11*b*, the one end of the inlet guide vane 11*a* is positioned backward of the other end of the inlet guide vane 11*a* in the clockwise direction. The inlet guide vane 31*a* is also constituted in a similar manner.

The heating mechanism 19 heats the inlet guide vane 11*a*. In more detail, the heating mechanism 19 includes a heating flow passage 19*a* through which a fluid for heating the inlet guide vane 11*a* is supplied, and a cooling flow passage 16 through which a fluid for cooling the motor 14 is supplied. The heating flow passage 19*a* extends toward the inlet guide vane 11*a* from the side opposite to the impeller 12 with the inlet guide vane 11*a* interposed therebetween. In other words, the heating flow passage 19*a* has an inlet 19*b* at the side opposite to the impeller 12 with the inlet guide vane 11*a* interposed therebetween. With such an arrangement, the fluid flowing through the heating flow passage 19*a* is less apt to be affected by heat generated from the impeller 12, and the temperature of the fluid flowing through the heating flow passage 19*a* is avoided from rising excessively. Thus, the above-mentioned arrangement is suitable for heating the inlet guide vane 11*a*.

The vane member 11 forms a part of the heating flow passage 19*a*. More specifically, the heating flow passage 19*a* is formed inside both the base 11*b* and the inlet guide vane 11*a*. Stated in another way, in this embodiment, the inside of the inlet guide vane 11*a* forms a part of the heating flow passage 19*a*. Thus, the inlet guide vane 11*a* can be heated effectively.

The annular groove in the bearing casing 18 also constitutes a part of the heating flow passage 19*a*. The heating flow passage 19*a* extends from the inlet 19*b* toward the annular groove in the bearing casing 18. Therefore, the fluid at a predetermined temperature is supplied to the surroundings of the bearing 17, and the bearing 17 is held at a proper temperature. The heating flow passage 19*a* extends up to an outlet 19*c* that is positioned away from the annular groove in the bearing casing 18 in the direction opposite to the impeller 12 with the inlet guide vane 11*a* interposed therebetween.

The casing 20 is disposed around the impeller 12 so as to surround the impeller 12. The casing 20 has a contact surface 20*a* contacting the inlet guide vane 11*a*. An inner circumferential surface of the casing 20 forms a portion of the inlet passage 10*a* between the inlet guide vane 11*a* and the impeller 12, the diffuser 10*b*, and the volute 10*c*. The casing 40 is disposed around the impeller 32 so as to surround the impeller 32. The casing 40 has a contact surface 40*a* contacting the inlet guide vane 31*a*. An inner circumferential surface of the casing 40 forms a portion of the inlet passage 30*a* between the inlet guide vane 31*a* and the impeller 32, the diffuser 30*b*, and the volute 30*c*.

The casing 20 includes the casing flow passage 22. The casing flow passage 22 is opened to the contact surface 20*a*, and it extends up to a space outside the casing 20 while penetrating through the casing 20. The casing flow passage 22 is connected to a portion of the heating flow passage 19*a*, the portion penetrating through the inlet guide vane 11*a*. In other words, the heating flow passage 19*a* is communicated with the casing flow passage 22 while it penetrates through the inlet guide vane 11*a*. The fluid flowing through the portion of the heating flow passage 19*a*, which penetrates through the inlet guide vane 11*a*, is discharged to the space outside the casing 20 after flowing through the casing flow passage 22. Therefore, the fluid is less apt to stagnate in the portion of the heating flow passage 19*a*, which penetrates through the inlet guide vane 11*a*.

The cooling flow passage 16 extends from an inlet 16*a*, which is formed in the outer circumferential surface of the center casing 25, toward the motor casing 15 and reaches the annular space R after penetrating through the center casing 25. The annular space R also forms a part of the cooling flow passage 16. The cooling flow passage 16 extends from the annular space R up to an outlet 16*b*, which is formed in the outer circumferential surface of the center casing 25, while penetrating through the center casing 25. The cooling flow passage 16 is a flow passage through which the fluid for cooling the motor 14 is to be supplied.

The outlet 16*b* of the cooling flow passage 16 and the inlet 19*b* of the heating flow passage 19*a* are connected to each other by the upstream passage 23. In other words, the cooling flow passage 16 is connected with the heating flow passage 19*a*. With such an arrangement, the fluid having passed through the cooling flow passage 16 is supplied to the heating flow passage 19*a* as the fluid for heating the inlet guide vane 11*a*. The valve 53 is disposed midway the upstream passage 23. The supply of the fluid to the heating flow passage 19*a* is controlled by opening and closing the valve 53. The valve 53 is, for example, a solenoid valve. The bypass passage 24 is branched from the upstream passage 23 at the upstream side of the valve 53. The bypass passage 24 is constituted such that the fluid having passed through the cooling flow passage 16 bypasses the heating flow passage 19*a*. The valve 54 is disposed midway the bypass passage 24. The valve 54 is, for example, a solenoid valve. The bypass passage 24 and the valve 54 may be omitted in some cases.

The inlet temperature sensor 51 is arranged in the inlet passage 10*a* at a position near the front end of the impeller 12. The inlet temperature sensor 51 detects the temperature of the working fluid at the front end side of the impeller 12. The heating-side temperature sensor 52 is disposed in the upstream passage 23 at, e.g., a position nearer to the cooling flow passage 16 than the valve 53. Furthermore, the position of the heating-side temperature sensor 52 is nearer to the cooling flow passage 16 than the position at which the bypass passage 24 is branched from the upstream passage 23. The heating-side temperature sensor 52 detects the temperature of the fluid supplied to the heating flow passage 19*a*. A detection signal of the inlet temperature sensor 51 and a detection signal of the heating-side temperature sensor 52 are input to the controller 50. In other words, the controller 50 has an input unit to which the detection signal of the inlet temperature sensor 51 and the detection signal of the heating-side temperature sensor 52 are input. The controller 50 controls opening and closing of the valve 53 or the valve 54. More specifically, the controller 50 has an output unit for outputting, to the valve 53 or the valve 54, a control signal to control opening and closing of the valve 53 or the valve 54. The valve 53 or the valve 54 is opened and closed in accordance with the control signal output from the controller 50.

Figure 3:
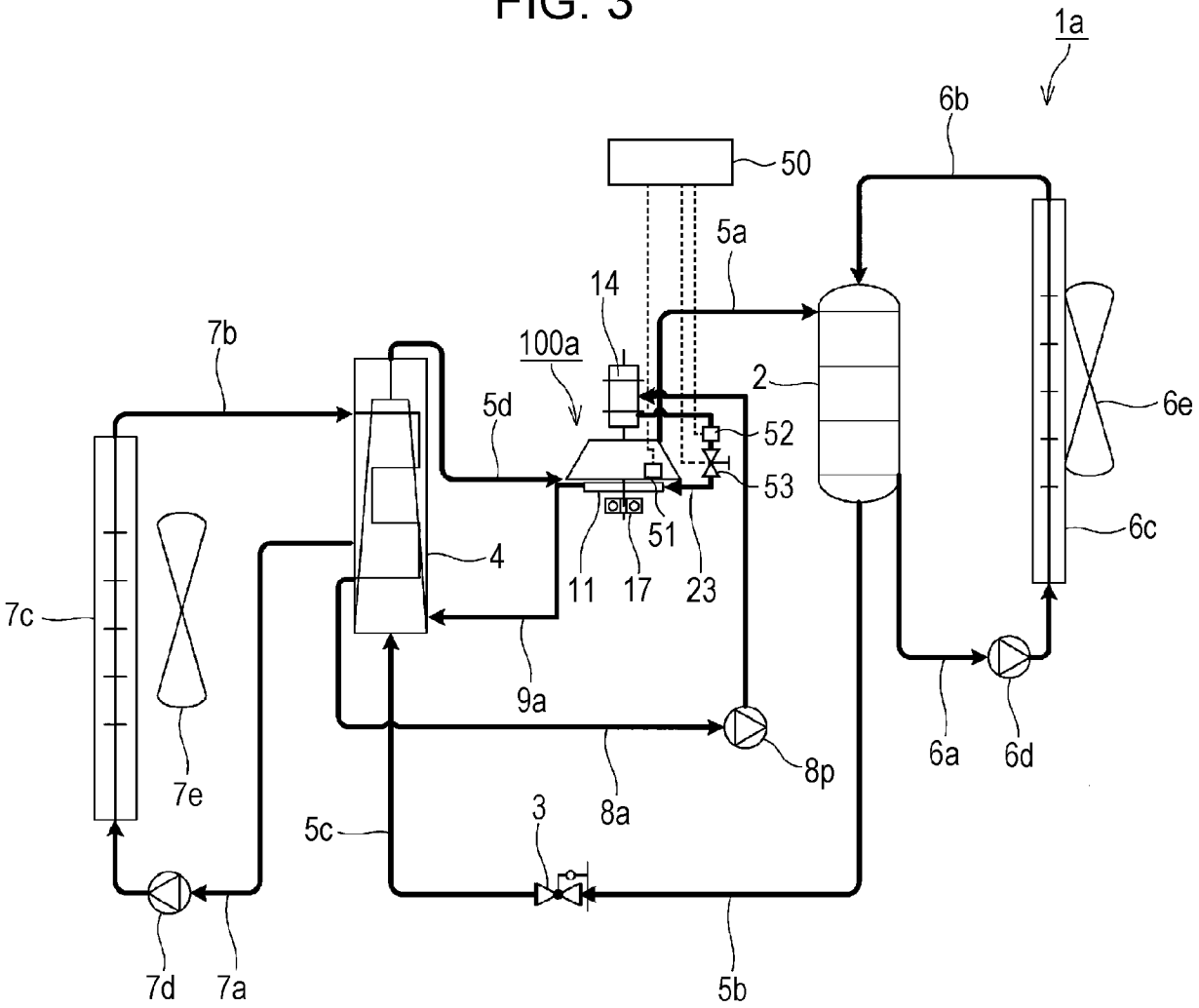
FIG. 3 is a schematic diagram of a refrigeration cycle apparatus according to the first embodiment.

A refrigeration cycle apparatus 1*a* according to this embodiment will be described below. As illustrated in FIG. 3, the refrigeration cycle apparatus 1*a* includes the turbo-compressor 100*a*, a condenser 2, a decompression mechanism 3, an evaporator 4, and fluid passages. The fluid passages are arranged such that the working fluid passes through the turbo-compressor 100*a*, the condenser 2, the decompression mechanism 3, and the evaporator 4. The fluid passages include a connection (flow) passage 5*a*, a connection passage 5*b*, a connection passage 5*c*, and a connection passage 5*d*. The fluid passages allow the working fluid to pass through the impeller inside the turbo-compressor 100*a*. The fluid passages includes, inside the turbo-compressor 100*a*, the inlet passages 10*a* and 30*a*, the diffusers 10*b* and 30*b*, and the volutes 10*c* and 30*c*. The condenser 2 condenses the working fluid that has been compressed by the turbo-compressor 100*a*. The decompression mechanism 3 reduces pressure of the working fluid that has been compressed by the condenser 2. The evaporator 4 evaporates the working fluid that has been depressurized by the decompression mechanism 3. The connection passage 5*a* connects the turbo-compressor 100*a* and the condenser 2. The connection passage 5*b* connects the condenser 2 and the decompression mechanism 3. The connection passage 5*c* connects the decompression mechanism 3 and the evaporator 4. The connection passage 5*d* connects the evaporator 4 and the turbo-compressor 100*a*. Thus, the connection passages 5*a* to 5*d* connect the turbo-compressor 100*a*, the condenser 2, the decompression mechanism 3, and the evaporator 4 in a looped way in the mentioned order.

The refrigeration cycle apparatus 1*a* further includes a feed passage 6*a*, a return passage 6*b*, a heat-dissipation heat exchanger 6*c*, a pump 6*d*, and a fan 6*e*. The feed passage 6*a* connects the condenser 2 and an upstream end of the heat-dissipation heat exchanger 6*c*. The pump 6*d* is disposed midway the feed passage 6*a*. The working fluid inside the heat-dissipation heat exchanger 6*c* is cooled with air blasting caused by the fan 6*e*. The heat-dissipation heat exchanger 6*c* is, for example, a fin tube type heat exchanger. The return passage 6*b* connects a downstream end of the heat-dissipation heat exchanger 6*c* and the condenser 2.

The refrigeration cycle apparatus 1*a* further includes a feed passage 7*a*, a return passage 7*b*, an endothermic heat exchanger 7*c*, a pump 7*d*, and a fan 7*e*. The feed passage 7*a* connects the evaporator 4 and an upstream end of the endothermic heat exchanger 7*c*. The pump 7*d* is disposed midway the feed passage 7*a*. The working fluid inside the endothermic heat exchanger 7*c* is heated with air blasting caused by the fan 7*e*. The endothermic heat exchanger 7*c* is, for example, a fin tube type heat exchanger. The return passage 7*b* connects a downstream end of the endothermic heat exchanger 7*c* and the evaporator 4.

The refrigeration cycle apparatus 1*a* further includes an injection passage 8*a* at the evaporator side, a pump 8*p*, and a return passage 9*a*. The injection passage 8*a* at the evaporator side connects the evaporator 4 and a particular position of the turbo-compressor 100*a* in communication with the heating flow passage 19*a*. More specifically, the injection passage 8*a* at the evaporator side connects the evaporator 4 and the cooling flow passage 16. The return passage 9*a* connects the turbo-compressor 100*a* and the evaporator 4. The fluid having passed through the heating flow passage 19*a* is returned to the evaporator 4 through the return passage 9*a*.

While the working fluid filled in the refrigeration cycle apparatus 1*a* is not limited to particular one, it is, e.g., a fluid having a negative saturated vapor pressure at an ordinary temperature (Japan Industrial Standard: 20° C.±15° C./JIS Z8703). An example of such a fluid is a fluid containing water, alcohol, or ether as a main component. When the fluid having a negative saturated vapor pressure at an ordinary temperature is used as the working fluid, the inside of the refrigeration cycle apparatus 1*a* is maintained at negative pressure lower than the atmospheric pressure by a vacuum pump (not illustrated), for example. In this embodiment, water is used as the working fluid.

Figure 4:
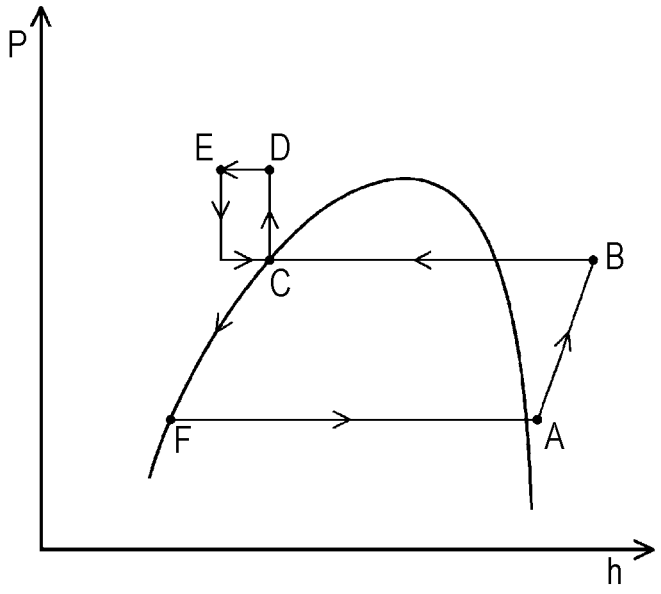
FIG. 4 is a graph depicting a P-h curve in the refrigeration cycle apparatus according to the first embodiment.

The operation of the refrigeration cycle apparatus 1*a* is described below with reference to FIG. 4. The working fluid (point A in FIG. 4) having boiled in the evaporator 4 is supplied to the turbo-compressor 100*a* through the connection passage 5*d*. The impeller 12 is rotated at a high speed by driving of the motor 14 together with the shaft 13. Therefore, the working fluid is caused to flow toward the impeller 12 through the inlet passage 10*a*. The working fluid flows through the inlet passage 10*a* while contacting the inlet guide vane 11*a* immediately before the working fluid is inlet into the impeller 12. The direction of flow of the working fluid flowing toward the impeller 12 is made uniform by the inlet guide vanes 11*a*. Thus, an inlet angle of the working fluid relative to the blades 12*a* of the impeller 12 is adjusted.

The fluid for heating the inlet guide vane 11*a* is supplied to the heating flow passage 19*a*. More specifically, the fluid at a higher temperature than the working fluid contacting the outer circumferential surface of the inlet guide vane 11*a* is supplied to the heating flow passage 19*a*. The temperature of the fluid supplied to the heating flow passage 19*a* is higher than that of the working fluid flowing through the inlet guide vane 11*a* by 2.0 to 5.0° C., for example, although the temperature difference is different depending on the operating conditions, the outdoor air conditions, etc. Thus, the inlet guide vane 11*a* heats the working fluid flowing toward the impeller 12. As indicated by the point A in FIG. 4, a degree of superheat of the working fluid flowing through the inlet passage 10*a* is comparatively small (e.g., the degree of superheat: (0.1 to 1)° C.). Accordingly, there is possibility that the working fluid flowing through the inlet passage 10*a* may come into a saturated vapor state or a wet steam state in some cases. Since the working fluid in the saturated vapor state or the wet steam state is heated by the inlet guide vane 11*a*, the degree of superheat or quality of the working fluid is increased. As a result, the working fluid is inlet in an appropriate state into the impeller 12.

The working fluid inlet into the impeller 12 is blown out by the blades 12*a*, rotating at a high speed, in a direction perpendicular to the axial direction of the shaft 13, and then flows through the diffuser 10*b* and the volute 10*c*, which are positioned outward of the impeller 12 in the radial direction. At that time, the flow speed of the working fluid having been increased by the impeller 12 is decelerated, whereby kinetic energy of the working fluid is converted to static pressure. In such a manner, the working fluid is compressed. The working fluid flowing through the volute 10*c* reaches the inlet passage 30*a* after exiting the volute 10*c*. Thereafter, the working fluid is inlet into the impeller 32, and then flows through the diffuser 30*b* and the volute 30*c*. Hence the working fluid is further compressed. Consequently, the working fluid is changed from the state of the point A to a state of a point B, illustrated in FIG. 4, by the turbo-compressor 100*a*.

The working fluid discharged from the turbo-compressor 100*a* is supplied to the condenser 2 through the connection passage 5*a*. The condenser 2 condenses the working fluid therein and stores a condensate. The condensate (point C in FIG. 4) stored in the condenser 2 is fed under pressure to the heat-dissipation heat exchanger 6*c* through the feed passage 6*a* by the pump 6*d* (point C→point D in FIG. 4). During a process of flowing through the heat-dissipation heat exchanger 6*c*, the working fluid is cooled through heat exchange with outdoor air, for example (point D→point E in FIG. 4). The working fluid having been output from the heat-dissipation heat exchanger 6*c* is returned to the condenser 2 through the return passage 6*b* (point E→point C in FIG. 4). The working fluid discharged from the turbo-compressor 100*a* is condensed (point B→point C in FIG. 4) through direct contact with the condensate that has been cooled by the heat-dissipation heat exchanger 6*c* and returned to the condenser 2.

The working fluid having been condensed to the condensate is supplied to the decompression mechanism 3 through the connection passage 5*b*. The pressure of the working fluid lowers (point C→point F in FIG. 4) after passing through the decompression mechanism 3. The temperature of the working fluid also lowers after passing through the decompression mechanism 3. The decompression mechanism 3 is, e.g., a decompression valve. When the refrigeration cycle apparatus 1*a* is operated to cool indoor air, for example, an opening degree of the decompression valve is set such that the temperature of the working fluid after the decompression is held at a value corresponding to the cooling temperature demanded for the refrigeration cycle apparatus 1*a*.

The working fluid having been depressurized by the decompression mechanism 3 is supplied to the evaporator 4 through the connection passage 5*c*. The evaporator 4 stores the working fluid in liquid phase and evaporates the liquid-phase working fluid therein. The liquid-phase working fluid stored in the evaporator 4 (point F in FIG. 4) is fed under pressure to the endothermic heat exchanger 7*c* through the feed passage 7*a* by the pump 7*d*. During a process of flowing through the endothermic heat exchanger 7*c*, the working fluid is heated through heat exchange with indoor air, for example. The working fluid having been output from the endothermic heat exchanger 7*c* is returned to the evaporator 4 through the return passage 7*b*. The working fluid having been returned to the evaporator 4 through the return passage 7*b* is caused to boil inside the evaporator 4 under the decompressed condition (point F→point A in FIG. 4). The working fluid having boiled in the evaporator 4 is supplied to the turbo-compressor 100*a* through the connection passage 5*d*.

The injection passage 8*a* at the evaporator side is connected to the evaporator 4 such that the liquid-phase working fluid is withdrawn from the evaporator 4 into the injection passage 8*a* at the evaporator side. Furthermore, the injection passage 8*a* at the evaporator side is communicated with the cooling flow passage 16 in the turbo-compressor 100*a*. Therefore, a part of the liquid-phase working fluid, stored in the evaporator 4, is supplied to the cooling flow passage 16 in the turbo-compressor 100*a* through the injection passage 9*a* at the evaporator side by the pump 8*p*. In other words, the working fluid cools the motor 14 while flowing through the cooling flow passage 16. The liquid-phase working fluid, stored in the evaporator 4, is at the lowest temperature in a cycle of the refrigeration cycle apparatus 1*a*, and is hence suitable for cooling the motor 14. The working fluid of which temperature has increased as a result of cooling the motor 14 is supplied to the heating flow passage 19*a* via the upstream passage 23 after passing through the cooling flow passage 16. Thus, the inlet guide vane 11*a* is heated as described above. The working fluid flowing through the portion of the heating flow passage 19*a*, which penetrates through the inlet guide vane 11*a*, flows into the casing flow passage 22. Because the casing flow passage 22 is communicated with the return passage 9*a*, the working fluid is returned to the evaporator 4 after flowing through the casing flow passage 22 and the return passage 9*a*.

The controller 50 controls the valve 53 such that the valve 53 is closed when the fluid temperature detected by the heating-side temperature sensor 52 is lower than the temperature of the working fluid detected by the inlet temperature sensor 51. In such a case, the controller 50 controls the valve 54 to be opened. As a result, the fluid having passed through the cooling flow passage 16 flows via the bypass passage 24 while bypassing the heating flow passage 19*a*. Because the fluid having passed through the cooling flow passage 16 flows via the bypass passage 24, cooling of the motor 14 can be continued. Furthermore, the controller 50 controls the valve 53 such that the valve 53 is opened when a difference between the fluid temperature detected by the heating-side temperature sensor 52 and the temperature of the working fluid detected by the inlet temperature sensor 51 is increased to a predetermined value (e.g., 2.0° C.) or more in the state where the valve 53 is closed. In such a case, the controller 50 controls the valve 54 to be closed. As a result, the fluid at lower temperature than the working fluid at the front end side of the impeller 12 can be avoided from being supplied to the heating flow passage 19*a*. Moreover, the fluid at temperature suitable for heating the inlet guide vane 11*a* can be supplied to the heating flow passage 19*a*.

A refrigeration cycle apparatus 1*b* according to another example of the first embodiment will be described below.

Figure 5:
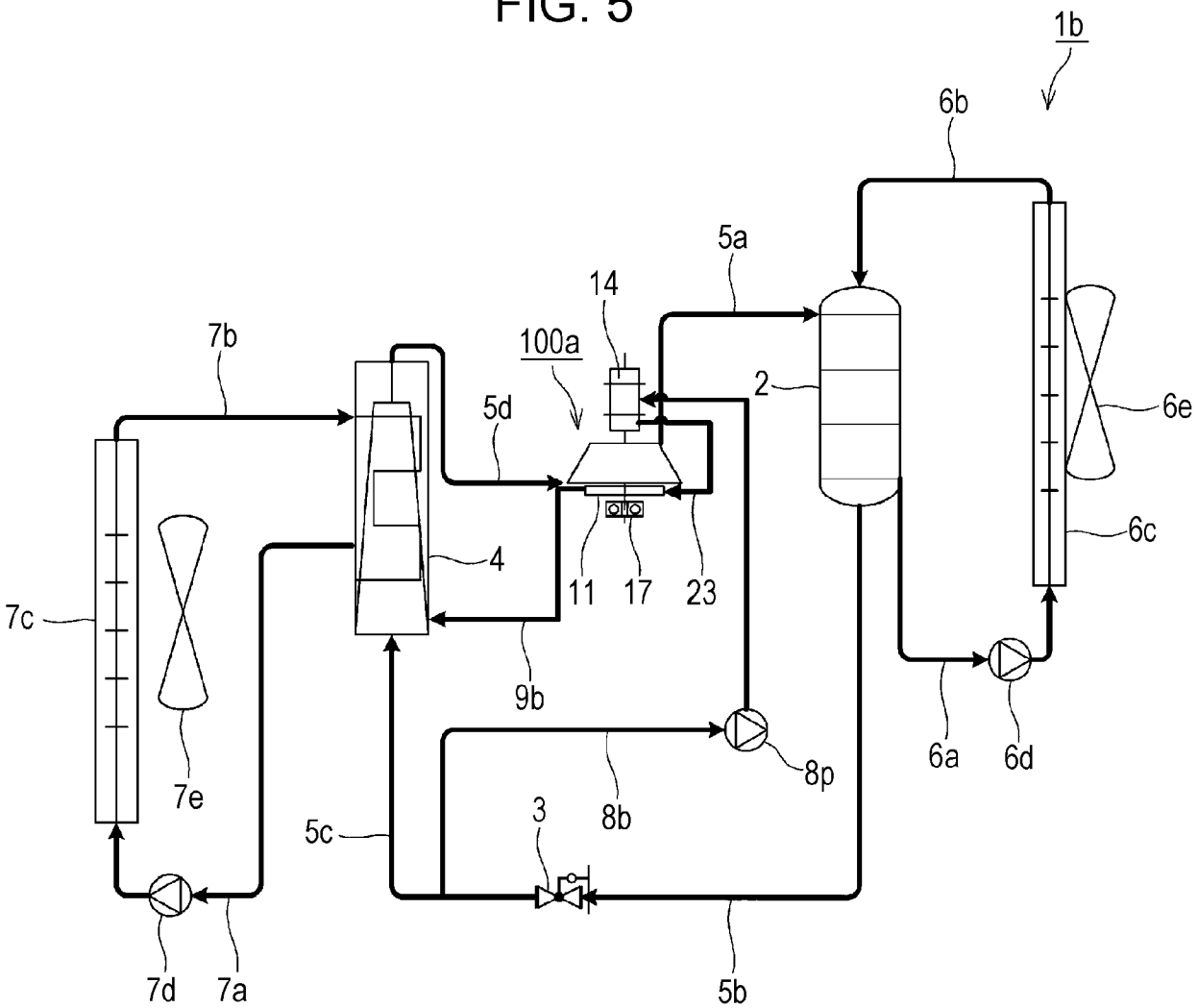
FIG. 5 is a schematic diagram of the refrigeration cycle apparatus according to the first embodiment.

As illustrated in FIG. 5, the refrigeration cycle apparatus 1*b* includes a connecting injection passage 8*b* instead of the injection passage 8*a* at the evaporator side. The connecting injection passage 8*b* connects the connection passage 5*b* or the connection passage 5*c* between the condenser 2 and the evaporator 4 to a particular position of the turbo-compressor 100*a* in communication with the heating flow passage 19*a*. More specifically, the connecting injection passage 8*b* is connected to the connection passage 5*c* such that the liquid-phase working fluid is withdrawn into the connecting injection passage 8*b* from the connection passage 5*c* between the evaporator 4 and the decompression mechanism 3. The connecting injection passage 8*b* is further communicated with the cooling flow passage 16 in the turbo-compressor 100*a*.

The pump 8*p* is disposed midway the connecting injection passage 8*b*. The liquid-phase working fluid in the connection passage 5*c* is supplied to the cooling flow passage 16 through the connecting injection passage 8*b* by the pump 9*p*. As in the first embodiment, the working fluid supplied to the cooling flow passage 16 flows through the cooling flow passage 16, the upstream passage 23, the heating flow passage 19*a*, the casing flow passage 22, and the return passage 9*a*, and then returns to the evaporator 4. The liquid-phase working fluid in the connection passage 5*c* is at the lowest temperature in a cycle of the refrigeration cycle apparatus 1*b*, and is hence suitable for cooling the motor 14. Moreover, the working fluid at temperature raised as a result of cooling the motor 14 is suitable for heating the inlet guide vane 11*a*.

<Modified Examples>

Figure 6:
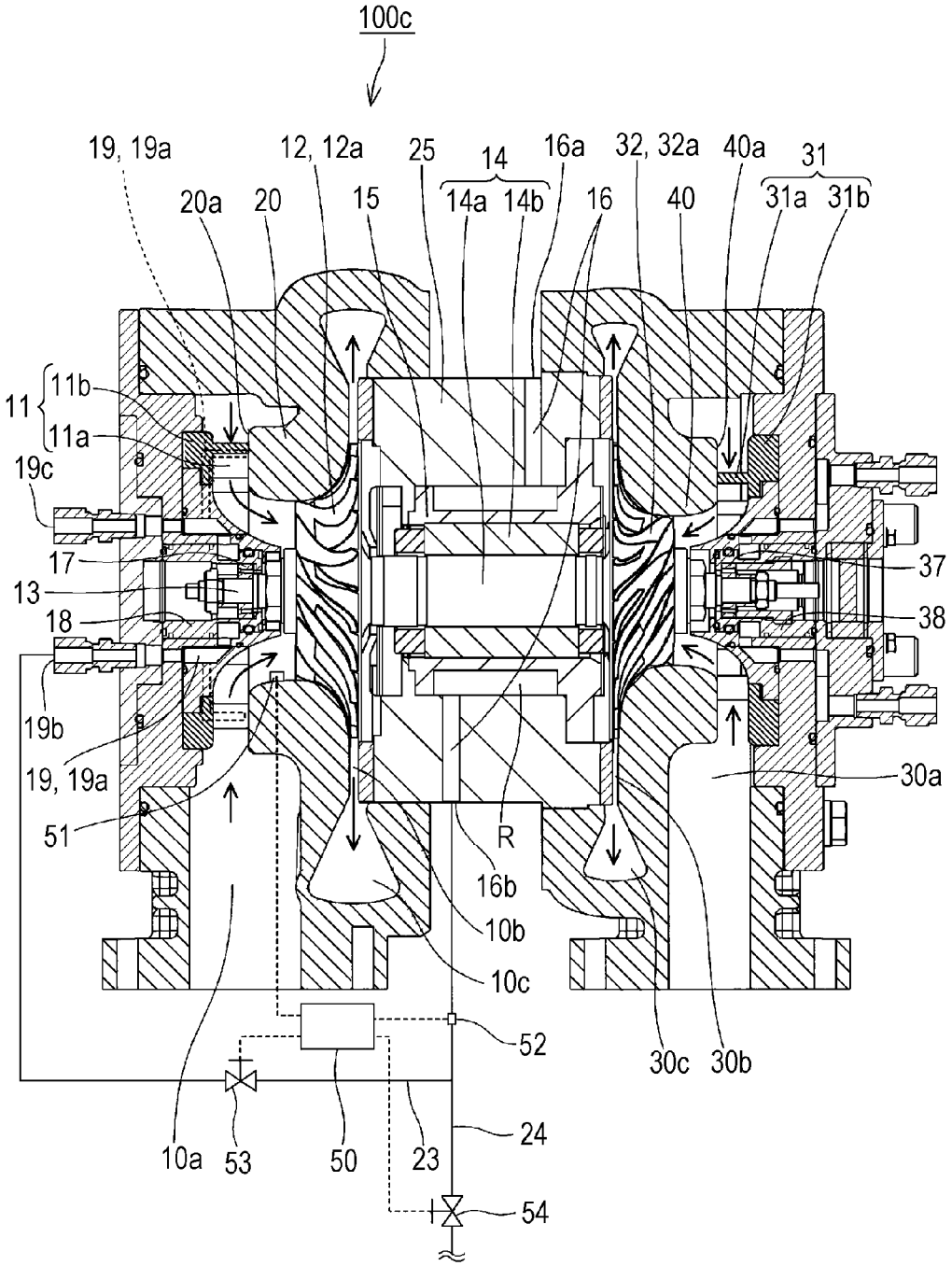
FIG. 6 is a cross sectional view of a turbo-compressor according to a first modified example.

The above-described embodiment can be modified from various points of view. FIG. 6 illustrates a turbo-compressor 100*c* according to a first modified example. The turbo-compressor 100*c* has the same structure as that of the turbo-compressor 100*a* according to the first embodiment except for the following points. In the turbo-compressor 100*c*, the casing 20 does not include the casing flow passage 22. Furthermore, while the inside of the inlet guide vane 11*a* forms a part of the heating flow passage 19*a*, the heating flow passage 19*a* does not penetrate through the inlet guide vane 11*a*. With such an arrangement, the inlet guide vane 11*a* can be directly heated by the fluid supplied to the heating flow passage 19*a*. Moreover, since there is no need of forming any flow passage in the casing 20, the structure of the turbo-compressor 100*c* can be simplified.

Figure 7:
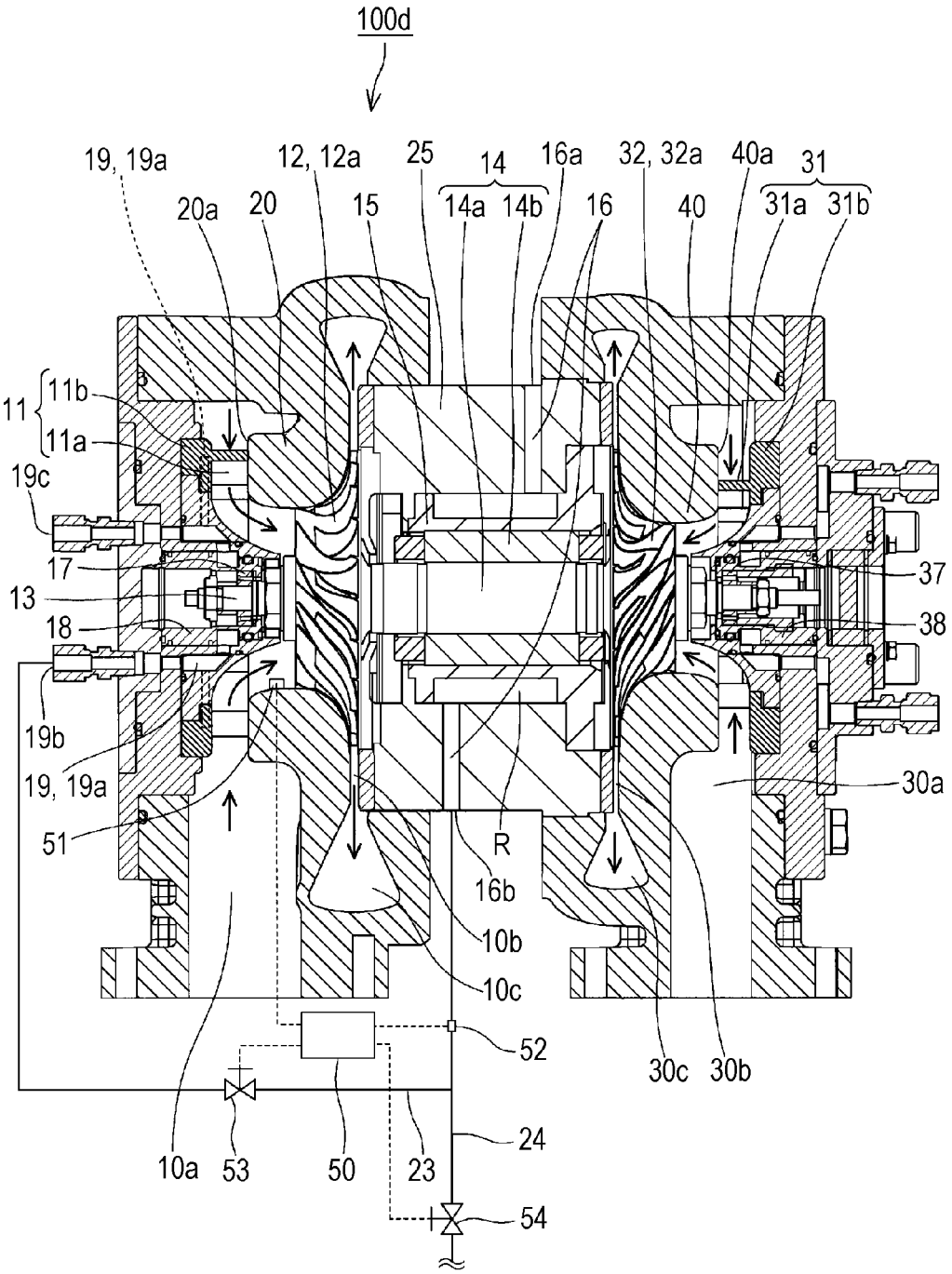
FIG. 7 is a cross sectional view of a turbo-compressor according to a second modified example.

FIG. 7 illustrates a turbo-compressor 100*d* according to a second modified example. The turbo-compressor 100*d* has the same structure as that of the turbo-compressor 100*a* according to the first embodiment except for the following points. In the turbo-compressor 100*d*, the casing 20 does not include the casing flow passage 22. Furthermore, only the base 11*b* of the vane member 11 forms a part of the heating flow passage 19*a*. With such an arrangement, the inlet guide vane 11*a* can be similarly heated by the fluid, which is supplied to the heating flow passage 19*a*, through thermal conduction via the base 11*b*. Moreover, a working process for forming the heating flow passage 19*a* can be simplified.

The heating mechanism 19 may be constituted, for example, by an electrical heater that heats the vane member 11.

The turbo-compressor 100*a* is constituted as a two-stage turbo-compressor in the embodiment, but it may be constituted as a single-stage turbo-compressor. Alternatively, the turbo-compressor 100*a* may be constituted as a multi-stage turbo-compressor including three or more stages of compression mechanisms.

With the first embodiment and the modified examples described above, since the exhaust heat of the motor can be used to heat the working fluid injected to the compressor, reduction in efficiency of the turbo-compressor caused by the provision of the heating mechanism can be prevented without providing a separate heat source. Furthermore, in the case of utilizing the exhaust heat of the motor, the working fluid injected to the turbo-compressor can be sufficiently heated, whereby the degree of superheat or quality of the working fluid can be increased. As a result, the desired operating conditions of the turbo-compressor can be maintained more easily, and durability of the turbo-compressor can be improved.

The first embodiment has been described in connection with an example in which the turbo-compressor includes the inlet guide vane and a part of the heating flow passage is a flow passage penetrating through the inlet guide vane that adjusts the direction of flow of the working fluid flowing toward the impeller. However, the turbo-compressor may be constituted as follows without including the inlet guide vane. For example, the turbo-compressor may include the heating flow passage, to which the fluid for heating the fluid passage is supplied, in intersection relation to the fluid passage upstream of the impeller. With such an arrangement, the heating mechanism can be constituted in a simple structure.

In that case, the heating flow passage may be inserted in the fluid passage, which is partly constituted by the casing, such that heat of the fluid supplied to the heating flow passage is transferred to the working fluid flowing through the fluid passage, which is constituted by the casing, from the outer circumference of the heating flow passage. With such an arrangement, since the fluid passage is partly constituted by the casing that surrounds the impeller, the structure of the turbo-compressor can be simplified when trying to heat the working fluid by utilizing the exhaust heat of the motor. Furthermore, with such an arrangement, the heating flow passage is inserted in the fluid passage that is partly constituted by the casing. Thus, the heat of the fluid supplied to the heating flow passage is transferred to the working fluid passing through the fluid passage, which is constituted by the casing, from the outer circumference of the heating flow passage. In other words, because the casing is disposed near the impeller, the heat of the fluid supplied to the heating flow passage can be transferred to the working fluid near the impeller. Hence, the degree of superheat of the working fluid can be increased at a location nearer to the impeller than in the related art. As a result, it is possible to prevent damage of the impeller, to more easily maintain the desired operating conditions of the turbo-compressor, and to improve durability of the turbo-compressor.

As another example, the heating flow passage, to which the fluid for heating the fluid passage in the turbo-compressor is supplied, may be disposed in contact with the outer circumference of the fluid passage upstream of the impeller. With such an arrangement, the heating mechanism can be constituted in a simple structure.

In that case, the fluid passage may be constituted by a part of the casing, and the fluid passage constituted by a part of the casing may contain a heating member therein. The heating flow passage may be disposed in contact with the outer circumference of the fluid passage constituted by the casing such that the heat of the fluid supplied to the heating flow passage is transferred to the heating member and further transferred via the heating member to the working fluid flowing through the fluid passage, which is constituted by the casing. With such an arrangement, since the fluid passage is partly constituted by the casing that surrounds the impeller, the structure of the turbo-compressor can be simplified when trying to heat the working fluid by utilizing the exhaust heat of the motor. Furthermore, with such an arrangement, the heating member is disposed inside the fluid passage that is constituted by a part of the casing, and the heating flow passage is disposed in contact with the circumference of the fluid passage that is constituted by the casing. Thus, the heat of the fluid supplied to the heating flow passage is transferred to the working fluid passing through the fluid passage, which is constituted by the casing, from the heating flow passage via the heating member. In other words, the heat of the fluid supplied to the heating flow passage can be transferred to the working fluid near the impeller. Hence, the degree of superheat of the working fluid can be increased at a location nearer to the impeller than in the related art. As a result, it is possible to prevent damage of the impeller, to more easily maintain the desired operating conditions of the turbo-compressor, and to improve durability of the turbo-compressor.

<Second Embodiment>

A second embodiment will be described below. In the first embodiment, the working fluid flowing toward the impeller of the turbo-compressor is heated by utilizing the exhaust heat of the motor. The second embodiment is not limited to the case of utilizing the exhaust heat of the motor. The process in accomplishing the invention of the second embodiment is first described.

As a result of studying a refrigeration cycle that employs, as a working fluid, a coolant of which saturated vapor pressure is negative (i.e., lower than the atmospheric pressure in terms of absolute pressure) at an ordinary temperature, the inventors have found the fact that, in the related-art turbo-compressors disclosed in Japanese Unexamined Patent Application Publication No. 8-233382 and No. 2009-85044, the desired operating conditions of the turbo-compressors are hard to maintain, and durability of the turbo-compressors is reduced.

In the turbo-refrigerator disclosed in Japanese Unexamined Patent Application Publication No. 8-233382, for example, because the working fluid is heated before it is inlet into the impeller of the turbo-compressor, a possibility that the working fluid inlet into the impeller of the turbo-compressor may contain droplets can be reduced. However, the heating device is positioned upstream of the inlet guide vane in the direction of flow of the working fluid, i.e., at a location away from the front end of the impeller. Therefore, when the working fluid is condensed while flowing through an inlet pipe between the heating device and the inlet guide vane, droplets generated with the condensation of the working fluid are inlet into the inside of the turbo-compressor. This leads to a possibility that erosion of blades of the impeller may occur. Moreover, because the heating device provides flow resistance against the flow of the working fluid, efficiency of the turbo-compressor is reduced.

The turbo-compressor disclosed in Japanese Unexamined Patent Application Publication No. 2009-85044 can suppress the occurrence of erosion caused by a liquid that has accumulated on the casing surface of the turbo-compressor. However, when the working fluid inlet into the impeller of the turbo-compressor contains droplets, those droplets strike against the blades of the impeller after being inlet into the impeller. This leads to a possibility that erosion may occur in the blades of the impeller.

On the basis of those findings, the inventors have conceived the disclosures set forth in the following embodiments of the present disclosure.

According to a first aspect of the present disclosure, there is provided a turbo-compressor including an impeller that is rotatably driven by a motor, a casing that surrounds the impeller, a fluid passage that is partly constituted by the casing, a working fluid being passed through the fluid passage via the impeller, and a heating flow passage that transfers heat generated by a predetermined heat source to the fluid passage upstream of the impeller, wherein the heating flow passage is disposed in intersection relation to the fluid passage that is partly constituted by the casing, heat of the fluid supplied to the heating flow passage is transferred from an outer circumference of the heating flow passage to the working fluid flowing through the fluid passage constituted by the casing, and the working fluid is compressed in the fluid passage downstream of the impeller.

With the first aspect, since the fluid passage is partly constituted by the casing that surrounds the impeller, the structure of the turbo-compressor can be simplified.

Furthermore, the heating flow passage is inserted in the fluid passage that is partly constituted by the casing. Thus, the heat of the fluid supplied to the heating flow passage is transferred to the working fluid passing through the fluid passage, which is constituted by the casing, from the outer circumference of the heating flow passage. In other words, because the casing is disposed near the impeller, the heat of the fluid supplied to the heating flow passage can be transferred to the working fluid near the impeller. Hence, the degree of superheat of the working fluid can be increased at a location nearer to the impeller than in the related art. As a result, it is possible to prevent damage of the impeller, to more easily maintain the desired operating conditions of the turbo-compressor, and to improve durability of the turbo-compressor.

In the turbo-refrigerator disclosed in Japanese Unexamined Patent Application Publication No. 8-233382, the working fluid is heated by the heating device that serves as a heat source. However, the heat source is not arranged near the impeller. Accordingly, there is a possibility that even when the working fluid is heated by the heat source, the working fluid may be condensed until the working fluid is inlet into the impeller. This leads to a possibility that the impeller may be damaged.

In the turbo-compressor disclosed in Japanese Unexamined Patent Application Publication No. 2009-85044, the fluid passage for the working fluid is formed in a U-like shape, and the working fluid having dissipated heat after passing through the U-shaped fluid passage is heated by utilizing the temperature of the working fluid itself. Thus, because the working fluid having dissipated heat after passing through the U-shaped fluid passage is heated at one lateral surface of the U-shaped fluid passage, there is a possibility that the heated temperature of the working fluid may be insufficient. Namely, as in the case of Japanese Unexamined Patent Application Publication No. 8-233382, there is a possibility that even when the working fluid is heated, the working fluid may be condensed until the working fluid is inlet into the impeller. This leads to a possibility that the impeller may be damaged.

In contrast, with the turbo-compressor according to the present disclosure, the heating flow passage is inserted in the fluid passage near the impeller. Therefore, the working fluid can be suppressed from being condensed until the working fluid is inlet into the impeller after being heated by the heat source. As a result, damage of the impeller can be suppressed significantly.

According to a second aspect of the present disclosure, as an exemplary modification in relation to the first aspect, a part of the heating flow passage is a flow passage penetrating through an inlet guide vane that adjusts a direction of flow of the working fluid flowing toward the impeller.

With the second aspect, since the inlet guide vane that adjusts the direction of flow of the working fluid flowing toward the impeller functions also as the heating flow passage, the working fluid can be effectively heated while the structure of the turbo-compressor is simplified.

The turbo-compressor disclosed in Japanese Patent No. 4109997 includes the inlet guide vane. However, Japanese Patent No. 4109997 does not disclose the configuration in which the working fluid is heated from the outside of the fluid passage. Thus, the inlet guide vane does not function as the cooling flow passage.

According to a third aspect of the present disclosure, as an exemplary modification in relation to the first or second aspect, the working fluid comprises a fluid having a negative saturated vapor pressure at an ordinary temperature.

The degree of superheat of the working fluid flowing toward the impeller of the turbo-compressor is comparatively small. Therefore, the working fluid flowing toward the impeller is changed to saturated vapor or wet steam even when slightly cooled. Thus, the effect of preventing condensation of the working fluid flowing toward the impeller can be more easily obtained with the feature of the third aspect of the present disclosure.

In the turbo-compressor disclosed in Japanese Patent No. 4109997, there is a possibility that vapor of the working fluid, which is generated in the evaporator, may not reach a state of the sufficient degree of superheat depending on the outside air temperature, etc. This leads to a possibility that the working fluid may become saturated vapor or wet steam because the working fluid is cooled in the flow passage extending from the evaporator to the turbo-compressor. In such a case, there is a possibility that the volumetric flow of the working fluid may be reduced, and the working fluid inlet into the impeller may come into an undesired state. For example, when the working fluid contains water as a main component, the volume ratio between the working fluid in liquid phase and the working fluid in vapor phase is about 1000 times under the atmospheric pressure. Thus, there is a risk that the turbo-compressor may be operated under conditions, which cannot be compensated for by adjustment of the flow of the working fluid with the inlet guide vane. When the working fluid containing droplets is inlet into the impeller of the turbo-compressor, there is a risk that those droplets may strike against the blades of the impeller, thereby causing erosion. This may result in a risk that the desired operating conditions of the turbo-compressor cannot be maintained, and durability of the turbo-compressor is reduced.

Furthermore, when a coolant having a negative saturated vapor pressure at an ordinary temperature is used as the working fluid, the impeller in the turbo-compressor is required to be rotated at a higher rotational speed. Moreover, in the case of employing the coolant having a negative saturated vapor pressure at an ordinary temperature, even when droplets are contained in the coolant in such a slight amount as not problematic in the case of employing a coolant having a positive saturated vapor pressure (i.e., pressure equal to or higher than the atmospheric pressure in terms of absolute pressure) at an ordinary temperature, erosion of the blades of the impeller occurs due to collision of the droplets (condensed working fluid) against the blades of the impeller.

In contrast, the turbo-compressor according to the present disclosure has an especially significant effect that, even when the coolant having a negative saturated vapor pressure at an ordinary temperature is used as the working fluid, the desired operating conditions of the turbo-compressor can be maintained more easily, and durability of the turbo-compressor can be improved in comparison with the turbo-compressor of the related art.

According to a fourth aspect of the present disclosure, there is provided a turbo-compressor including an impeller that is rotatably driven by a motor, a casing that surrounds the impeller, a fluid passage that is partly constituted by the casing, a working fluid to being passed through the fluid passage via the impeller, and a heating flow passage that transfers heat generated by a predetermined heat source to the fluid passage upstream of the impeller, wherein the flow passage constituted by a part of the casing includes a heating member therein, the heating flow passage is disposed in contact with an outer circumference of the flow passage constituted by the casing, and heat of the fluid supplied to the heating flow passage is transferred to the heating member and is transferred, via the heating member, to the working fluid passing through the fluid passage that is constituted by the casing.

With the fourth aspect, since the fluid passage is partly constituted by the casing that surrounds the impeller, the structure of the turbo-compressor can be simplified in the case of trying to heat the working fluid by utilizing the exhaust heat of the motor.

Furthermore, the heating member is disposed in the fluid passage that is partly constituted by the casing. The heating flow passage is disposed in contact with the outer circumference of the flow passage constituted by the casing. Thus, the heat of the fluid supplied to the heating flow passage is transferred, via the heating member, from the heating flow passage to the working fluid passing through the fluid passage that is constituted by the casing. In other words, the heat of the fluid supplied to the heating flow passage can be transferred to the working fluid near the impeller. Hence, the degree of superheat of the working fluid can be increased at a location nearer to the impeller than in the related art. As a result, it is possible to prevent damage of the impeller, to more easily maintain the desired operating conditions of the turbo-compressor, and to improve durability of the turbo-compressor.

The turbo-compressor according to the fourth aspect of the present disclosure is superior in the following points to the turbo-refrigerator disclosed in Japanese Unexamined Patent Application Publication No. 8-233382 and the turbo-compressor disclosed in Japanese Unexamined Patent Application Publication No. 2009-85044.

In the turbo-refrigerator disclosed in Japanese Unexamined Patent Application Publication No. 8-233382, the working fluid is heated by the heating device that serves as a heat source. However, the heat source is not arranged near the impeller. Accordingly, there is a possibility that even when the working fluid is heated by the heat source, the working fluid may be condensed until the working fluid is inlet into the impeller. This leads to a possibility that the impeller may be damaged.

In the turbo-compressor disclosed in Japanese Unexamined Patent Application Publication No. 2009-85044, the fluid passage for the working fluid is formed in a U-like shape, and the working fluid having dissipated heat after passing through the U-shaped fluid passage is heated by utilizing the temperature of the working fluid itself. Thus, because the working fluid having dissipated heat after passing through the U-shaped fluid passage is heated at one lateral surface of the U-shaped fluid passage, there is a possibility that the heated temperature of the working fluid may be insufficient. Namely, as in the case of Japanese Unexamined Patent Application Publication No. 8-233382, there is a possibility that even when the working fluid is heated, the working fluid may be condensed until the working fluid is inlet into the impeller. This leads to a possibility that the impeller may be damaged.

In contrast, with the turbo-compressor according to the present disclosure, the heating flow passage is disposed in contact with the circumference of the fluid passage, which is constituted by the casing, near the impeller. Therefore, the working fluid can be suppressed from being condensed until the working fluid is inlet into the impeller after being heated by the heat source. As a result, damage of the impeller can be suppressed significantly.

According to a fifth aspect of the present disclosure, as an exemplary modification in relation to the fourth aspect, a part of the heating flow passage is a flow passage penetrating through an inlet guide vane that adjusts a direction of flow of the working fluid flowing toward the impeller.

With the fifth aspect, since the inlet guide vane that adjusts the direction of flow of the working fluid flowing toward the impeller functions also as the heating flow passage, the working fluid can be effectively heated while the structure of the turbo-compressor is simplified.

The turbo-compressor disclosed in Japanese Patent No. 4109997 includes the inlet guide vane. However, Japanese Patent No. 4109997 does not disclose the configuration in which the working fluid is heated from the outside of the fluid passage. Thus, the inlet guide vane does not function as the heating flow passage.

In the turbo-compressor according to any of the above-described aspects, the heat generated from the predetermined heat source may be, for example, heat generated with rotation of the motor.

According to a sixth aspect of the present disclosure, as an exemplary modification in relation to the fourth or fifth aspect, the working fluid comprises a fluid having a negative saturated vapor pressure at an ordinary temperature.

The degree of superheat of the working fluid flowing toward the impeller of the turbo-compressor is comparatively small. Therefore, the working fluid flowing toward the impeller is changed to saturated vapor or wet steam even when slightly cooled. Thus, the effect of preventing condensation of the working fluid flowing toward the impeller can be more easily obtained with the feature of the sixth aspect of the present disclosure.

In the turbo-compressor disclosed in Japanese Patent No. 4109997, there is a possibility that vapor of the working fluid, which is generated in the evaporator, may not reach a state of the sufficient degree of superheat depending on the outside air temperature, etc. This leads to a possibility that the working fluid may become saturated vapor or wet steam because the working fluid is cooled in the flow passage extending from the evaporator to the turbo-compressor. In such a case, there is a possibility that the volumetric flow of the working fluid may be reduced, and the working fluid inlet into the impeller may come into an undesired state. For example, when the working fluid contains water as a main component, the volume ratio between the working fluid in liquid phase and the working fluid in vapor phase is about 1000 times under the atmospheric pressure. Thus, there is a risk that the turbo-compressor may be operated under conditions, which cannot be compensated for by adjustment of the flow of the working fluid with the inlet guide vane. When the working fluid containing droplets is inlet into the impeller of the turbo-compressor, there is a risk that those droplets may strike against the blades of the impeller, thereby causing erosion. This may result in a risk that the desired operating conditions of the turbo-compressor cannot be maintained, and durability of the turbo-compressor is reduced.

Furthermore, when a coolant having a negative saturated vapor pressure at an ordinary temperature is used as the working fluid, the impeller in the turbo-compressor is required to be rotated at a higher rotational speed. Moreover, in the case of employing the coolant having a negative saturated vapor pressure at an ordinary temperature, even when droplets are contained in the coolant in such a slight amount as not problematic in the case of employing a coolant having a positive saturated vapor pressure (i.e., pressure equal to or higher than the atmospheric pressure in terms of absolute pressure) at an ordinary temperature, erosion of the blades of the impeller occurs due to collision of the droplets (condensed working fluid) against the blades of the impeller.

In contrast, the turbo-compressor according to the present disclosure has an especially significant effect that, even when the coolant having a negative saturated vapor pressure at an ordinary temperature is used as the working fluid, the desired operating conditions of the turbo-compressor can be maintained more easily, and durability of the turbo-compressor can be improved in comparison with the turbo-compressor of the related art.

The second embodiment is constituted similarly to the first embodiment except for points specifically explained below. Components of the second embodiment identical or corresponding to those in the first embodiment are denoted by the same reference signs as those in the first embodiment, and detailed description of those components is omitted in some cases. The above description related to the first embodiment can be applied to the second embodiment as well insofar as there is no technical contradiction when applied to both the embodiments.

Figure 8:
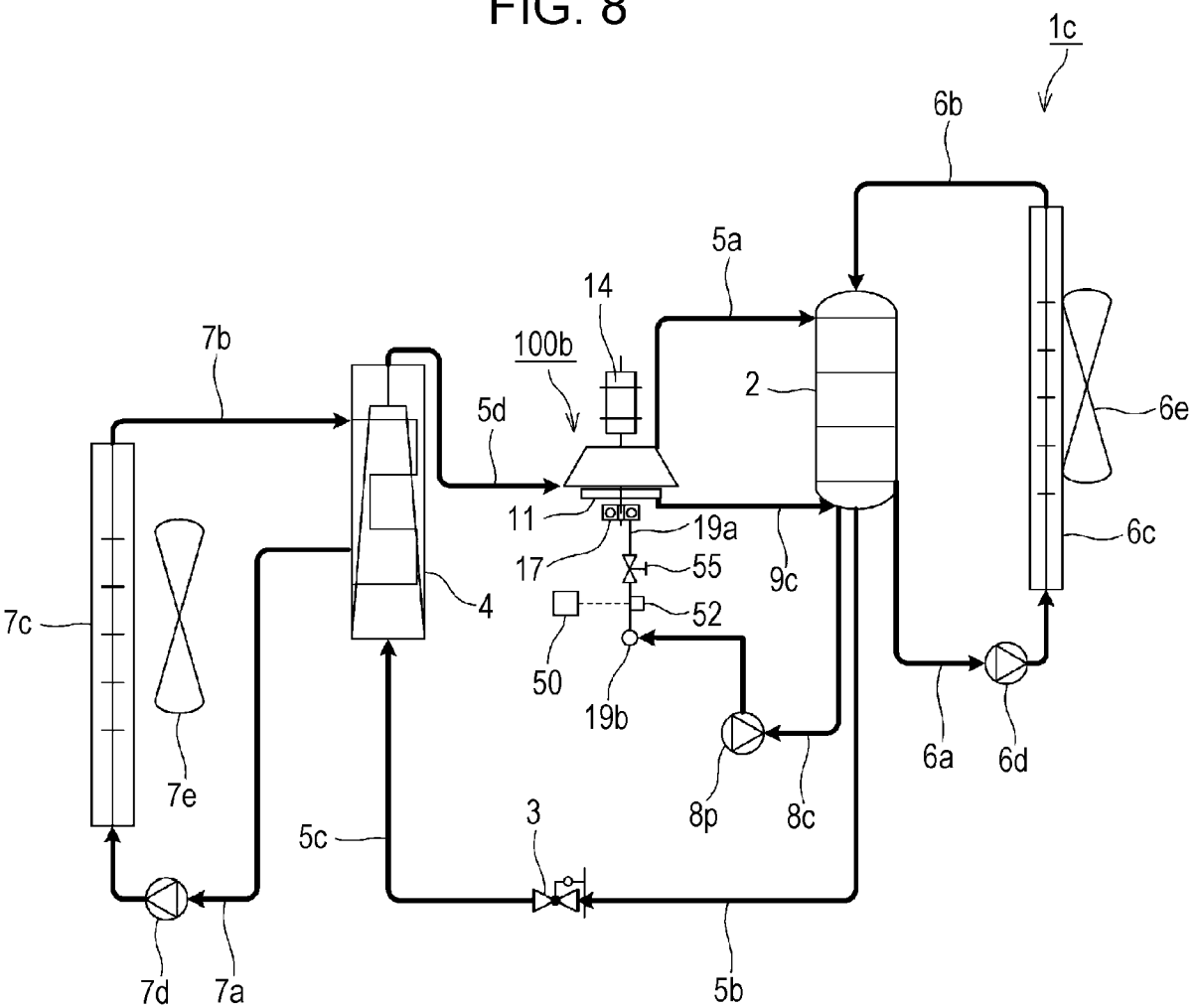
FIG. 8 is a schematic diagram of a refrigeration cycle apparatus according to a second embodiment.

One example of a refrigeration cycle apparatus according to the second embodiment will be described below. As illustrated in FIG. 8, a refrigeration cycle apparatus 1*c* includes an injection passage 8*c* at the condenser side instead of the injection passage 8*a* at the evaporator side. In addition, the refrigeration cycle apparatus 1*c* includes a turbo-compressor 100*b* instead of the turbo-compressor 100*a*.

The turbo-compressor 100*b* has the same structure as that of the turbo-compressor 100*a* except for the following points. The turbo-compressor 100*b* does not include the upstream passage 23. Instead of the valve 53, a valve 55 is disposed in the heating flow passage 19*a*. The valve 55 is, for example, a solenoid valve. The valve 55 is disposed in the heating flow passage 19*a* at a position upstream of the vane member 11. The heating-side temperature sensor 52 is disposed in a portion of the heating flow passage 19*a* between the inlet 19*b* and the valve 55. Thus, the heating-side temperature sensor 52 detects the temperature of the fluid in the heating flow passage 19*a*.

The injection passage 8*c* at the condenser side connects the condenser 2 and a particular position of the turbo-compressor 100*b* in communication with the heating flow passage 19*a*. More specifically, the injection passage 8*c* at the condenser side is connected to the inlet 19*b* of the heating flow passage 19*a*.

A pump 8*p* is disposed midway the injection passage 8*c* at the condenser side. A part of the condensate stored in the condenser 2 is supplied to the heating flow passage 19*a* through the injection passage 8*c* at the condenser side by the pump 8*p*. The refrigeration cycle apparatus 1*c* has the function of generating indoor air at lower temperature than outdoor air. Accordingly, in the heat-dissipation heat exchanger 6*c* for dissipating the heat of the working fluid to the outdoor air, the working fluid is at higher temperature than the outdoor air. Furthermore, in the endothermic heat exchanger 7*c* in which the working fluid absorbs heat from the indoor air, the working fluid is at lower temperature than the indoor air. Therefore, the working fluid in a state of the condensate stored in the condenser is always at higher temperature than the working fluid that flows into the turbo-compressor 100*b* after having boiled in the evaporator 4. As a result, during the rated operation of the refrigeration cycle apparatus 1*c*, the fluid at higher temperature than the working fluid passing through the inlet guide vane 11*a* can be supplied to the heating flow passage 19*a* via the injection passage 8*c* at the condenser side.

In a transient state at the start or the end of the operation, for example, there is a possibility that the refrigeration cycle apparatus 1*c* cannot supply, to the heating flow passage 19*a*, the fluid at higher temperature than the working fluid passing through the inlet guide vane 11*a*. To cope with such a case, the controller 50 controls the valve 55 such that the valve 55 is closed when the temperature of the fluid detected by the heating-side temperature sensor 52 is lower than that of the working fluid detected by the inlet temperature sensor 51. Furthermore, the controller 50 controls the valve 55 such that the valve 55 is opened when a difference between the fluid temperature detected by the heating-side temperature sensor 52 and the temperature of the working fluid detected by the inlet temperature sensor 51 is increased to a predetermined value (e.g., 2.0° C.) or more in the state where the valve 55 is closed. As a result, it is possible to avoid a situation that the inlet guide vane 11*a* cools the working fluid flowing toward the impeller 12.

Figure 9:
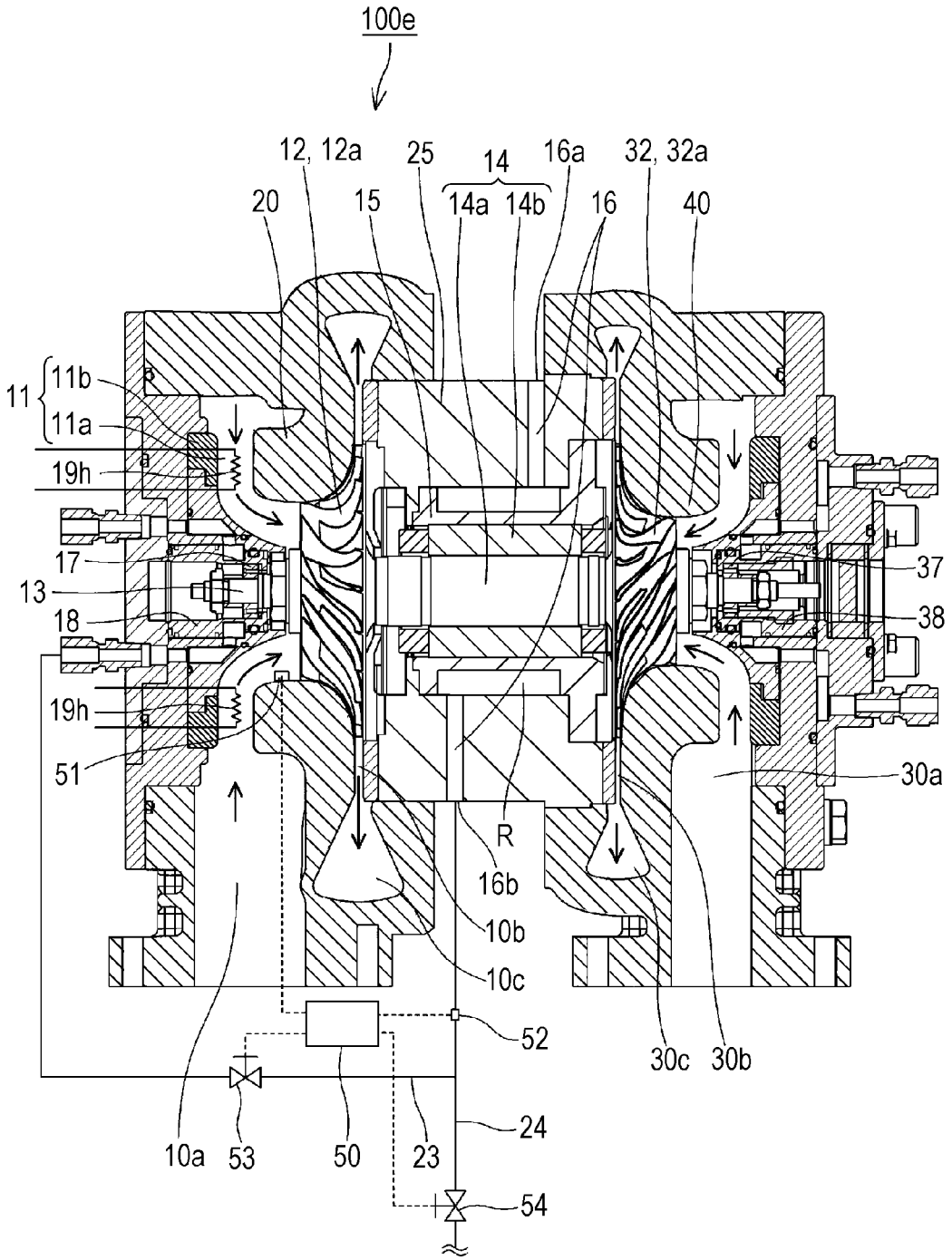
FIG. 9 is a cross sectional view of a turbo-compressor according to the second embodiment.

FIG. 9 illustrates one example of a turbo-compressor according to the second embodiment. A turbo-compressor 100*e* has the same structure as that of the turbo-compressor 100*a* according to the first embodiment except for the following points. The turbo-compressor 100*e* includes a heating mechanism 19*h*, which is disposed at the front end side of the blades 12*a* of the impeller 12, without including the inlet guide vane 11*a*. The heating mechanism 19*h* is positioned in the inlet passage 100*a* near the front ends of the blades 12*a*. The heating mechanism 19*h* is disposed in a state partly blocking a flow passage through which the working fluid flows toward the impeller. The heating mechanism 19*h* includes, for example, a fluid passage through which the fluid for heating the working fluid flowing toward the impeller 12 is to be supplied. The heating mechanism 19*h* is, for example, an electric heater.

A refrigeration cycle apparatus can be constituted, as in the first embodiment, by employing the turbo-compressor 100*e* instead of the turbo-compressor 100*a*. The working fluid used in such a refrigeration cycle apparatus is a fluid having a negative saturated vapor pressure at an ordinary temperature. In this case, as depicted in FIG. 4, the degree of superheat of the working fluid flowing toward the impeller 12 of the turbo-compressor 100*e* is comparatively small. Accordingly, there is a possibility that the working fluid may come into a saturated vapor state or a wet steam state in some cases. In the above-mentioned example, the degree of superheat or quality of the working fluid can be increased by heating the working fluid, which is in the saturated vapor state or the wet steam state, with the heating mechanism 19*h*. As a result, the working fluid is inlet in an appropriate state into the impeller 12.

What is claimed is:

1. A turbo-compressor comprising:

an impeller;

a motor that generates heat by rotation of the motor and rotatably drives the impeller;

a fluid passage through which a working fluid is passed by the impeller;

a cooling flow passage that is supplied with a cooling fluid, the cooling fluid being used for cooling the motor when the cooling fluid is passed by the motor;

a heating flow passage that is disposed in an intersecting relationship with a fluid passage upstream of the impeller and that is supplied with a heating fluid, the heating fluid being used for heating a fluid passage that passes through an intersection of the heating flow passage and the fluid passage upstream of the impeller, the cooling flow passage being connected with the heating flow passage, the cooling fluid having passed through the cooling flow passage being supplied to the heating flow passage as the heating fluid for heating the fluid passage; and a casing that surrounds the impeller, wherein the casing includes a part of the fluid passage through which the working fluid is passed, the heating flow passage is inserted in the part of the fluid passage in the casing, heat of the heating fluid supplied to the heating flow passage is transferred from an outer circumference of the heating flow passage to the working fluid passing through the part of the fluid passage in the casing, and a part of the heating flow passage is a flow passage penetrating through an inlet guide vane that adjusts a direction of flow of the working fluid flowing toward the impeller.

2. The turbo-compressor according to claim 1, further comprising a vane member, the vane member including a base on which the inlet guide vane is arranged, and the inlet guide vane, wherein the base forms a part of the heating flow passage, and the part of the heating flow passage formed in the base is coupled to the inlet guide vane that serves as the heating flow passage.

3. The turbo-compressor according to claim 1, wherein the casing has a contact surface contacting the inlet guide vane, wherein the casing includes a casing flow passage that is opened to the contact surface, and that extends up to a space outside the casing, and wherein the heating flow passage penetrates through the inlet guide vane to be communicated with the casing flow passage.

4. The turbo-compressor according to claim 1, wherein the heating flow passage has an inlet on side opposite to the impeller with the inlet guide vane interposed between the inlet and the impeller.

5. The turbo-compressor according to claim 1, wherein temperature of the fluid supplied to the heating flow passage is higher than temperature of the working fluid in contact with the outer circumference of the inlet guide vane.

6. The turbo-compressor according to claim 1, further comprising:

an inlet temperature sensor that detects temperature of the working fluid at front end side of the impeller;

a heating-side temperature sensor that detects temperature of the fluid in the heating flow passage or temperature of the fluid to be supplied to the heating flow passage;

a valve disposed in the heating flow passage upstream of a position at which the working fluid passing through the fluid passage is heated by the fluid flowing through the heating flow passage; and a controller controlling the valve to be closed when the fluid temperature detected by the heating-side temperature sensor is lower than the temperature of the working fluid detected by the inlet temperature sensor.

7. The turbo-compressor according to claim 1, wherein the working fluid comprises a fluid having a negative saturated vapor pressure at an ordinary temperature.

8. A refrigeration cycle apparatus comprising:

the turbo-compressor according to claim 1;

a condenser that condenses the working fluid having been compressed by the turbo-compressor;

a depressurization mechanism that reduces pressure of the working fluid having been condensed by the condenser;

an evaporator that evaporates the working fluid having been depressurized by the depressurization mechanism; and connection passages that connect the turbo-compressor, the condenser, the depressurization mechanism, and the evaporator in a looped way in mentioned order, wherein the refrigeration cycle apparatus further includes:

(i) an injection passage at evaporator side, which connects the evaporator to a particular position of the turbo-compressor in communication with the heating flow passage, or (ii) a connecting injection passage that connects the connection passage between the condenser and the evaporator to a particular position of the turbo-compressor in communication with the heating flow passage.

9. The refrigeration cycle apparatus according to claim 8, wherein when the refrigeration cycle apparatus includes the injection passage at evaporator side, the injection passage at evaporator side is connected to the evaporator such that the working fluid in liquid phase is withdrawn into the injection passage at evaporator side from the evaporator, and the injection passage at evaporator side is communicated with the cooling flow passage of the turbo-compressor, and when the refrigeration cycle apparatus includes the connecting injection passage, the connecting injection passage is connected to the connection passage such that the working fluid in liquid phase is withdrawn into the connecting injection passage from the connection passage between the evaporator and the depressurization mechanism, and the connecting injection passage is communicated with the cooling flow passage of the turbo-compressor.

10. The refrigeration cycle apparatus according to claim 8, wherein the working fluid comprises a fluid having a negative saturated vapor pressure at an ordinary temperature.

* * * * *